US011646170B2

(12) United States Patent
Yamazaki et al.

(10) Patent No.: US 11,646,170 B2
(45) Date of Patent: May 9, 2023

(54) MEMS ELEMENT AND ELECTRICAL CIRCUIT

(71) Applicant: KABUSHIKI KAISHA TOSHIBA, Tokyo (JP)

(72) Inventors: Hiroaki Yamazaki, Kanagawa (JP); Kei Masunishi, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 56 days.

(21) Appl. No.: 17/186,387

(22) Filed: Feb. 26, 2021

(65) Prior Publication Data

US 2022/0084767 A1 Mar. 17, 2022

(30) Foreign Application Priority Data

Sep. 15, 2020 (JP) ..... JP2020-154739

(51) Int. Cl.
*H01H 59/00* (2006.01)
*H01H 1/00* (2006.01)

(52) U.S. Cl.
CPC ..... *H01H 59/0009* (2013.01); *H01H 1/0036* (2013.01)

(58) Field of Classification Search
CPC ..... H01H 59/0009; H01H 1/0036; B81B 2203/0109; B81B 2203/01
See application file for complete search history.

(56) References Cited

U.S. PATENT DOCUMENTS 7,119,943 B2 * 10/2006 Nelson ..... H01H 59/0009 359/290
2020/0076394 A1 3/2020 Ikehashi et al.
2021/0175035 A1 6/2021 Yamazaki

FOREIGN PATENT DOCUMENTS

JP S59-121730 A 7/1984
JP 2020-35828 A 3/2020
JP 2021-91024 A 6/2021

* cited by examiner

*Primary Examiner* — Vanessa Girardi
(74) *Attorney, Agent, or Firm* — Finnegan, Henderson, Farabow, Garrett & Dunner, LLP

(57) ABSTRACT

According to one embodiment, a MEMS element includes a first member, and an element part. The element part includes a first fixed electrode fixed to the first member, a first movable electrode facing the first fixed electrode, a first conductive member electrically connected to the first movable electrode, and a second conductive member electrically connected to the first movable electrode. The first movable electrode is supported by the first and second conductive members to be separated from the first fixed electrode. The first conductive member has a meandering structure. The second conductive member includes a first conductive region and a second conductive region. The second conductive region is between the first movable electrode and the first conductive region. A second width of the second conductive region along a second direction is less than a first width of the first conductive region along the second direction.

17 Claims, 14 Drawing Sheets

MEMS ELEMENT AND ELECTRICAL CIRCUIT

CROSS-REFERENCE TO RELATED APPLICATIONS

This application is based upon and claims the benefit of priority from Japanese Patent Application No. 2020-154739, filed on Sep. 15, 2020; the entire contents of which are incorporated herein by reference.

FIELD

Embodiments of the invention generally relate to a MEMS element and an electrical circuit.

BACKGROUND

For example, a MEMS (Micro Electro Mechanical Systems) element is used in a switch or the like. A stable operation of the MEMS element is desirable.

DETAILED DESCRIPTION

Figure 1A:
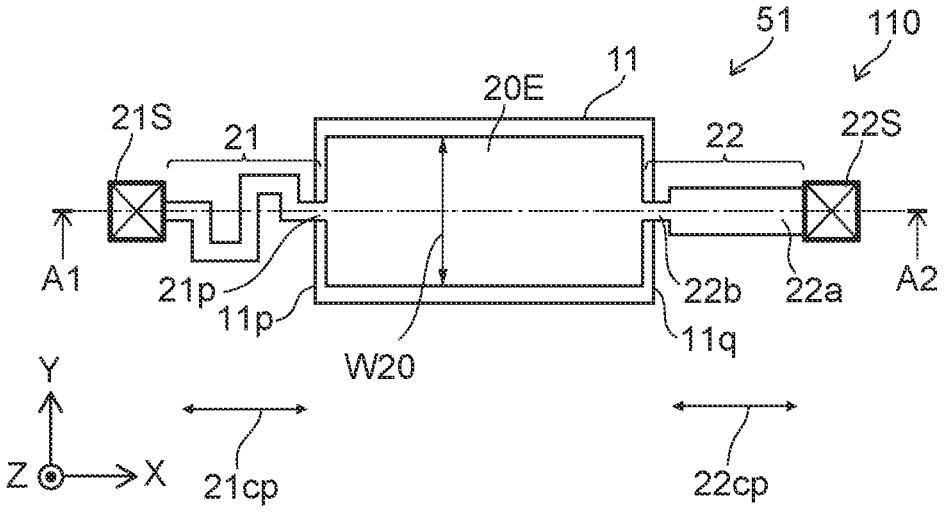
FIGS. 1A and 1B are schematic views illustrating a MEMS element according to a first embodiment.

According to one embodiment, a MEMS element includes a first member, and an element part. The element part includes a first fixed electrode fixed to the first member, a first movable electrode facing the first fixed electrode, a first conductive member electrically connected to the first movable electrode, and a second conductive member electrically connected to the first movable electrode. The first movable electrode is supported by the first and second conductive members to be separated from the first fixed electrode. The first conductive member has a meandering structure. The second conductive member includes a first conductive region and a second conductive region. The second conductive region is between the first movable electrode and the first conductive region. A second width of the second conductive region along a second direction is less than a first width of the first conductive region along the second direction. The second direction crosses a first direction from the first movable electrode toward the first conductive region.

According to one embodiment, a MEMS element includes a first member, and an element part. The element part includes a first fixed electrode fixed to the first member, a first movable electrode facing the first fixed electrode, a first conductive member electrically connected to the first movable electrode, and a second conductive member electrically connected to the first movable electrode. The first movable electrode is supported by the first and second conductive members to be separated from the first fixed electrode. The first movable electrode includes a second connection part connected with the first conductive member, and a first connection part connected with the second conductive member. A width of the first movable electrode along a second direction increases in an orientation from the first connection part toward the second connection part in at least a portion of the first movable electrode. The second direction crosses a first direction from the first connection part toward the second connection part.

According to one embodiment, an electrical circuit includes the MEMS dement described in any one of the MEMS elements described above, and an electrical element electrically connected to the MEMS dement.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

First Embodiment

Figure 1B:
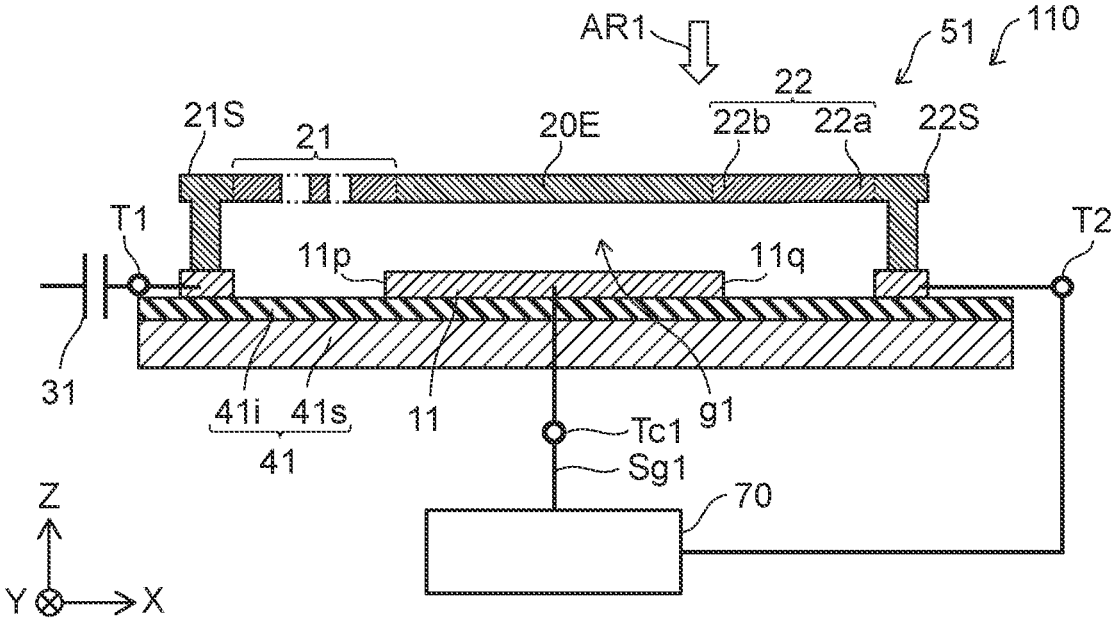

FIGS. 1A and 1B are schematic views illustrating a MEMS element according to a first embodiment.

Figure 2A:
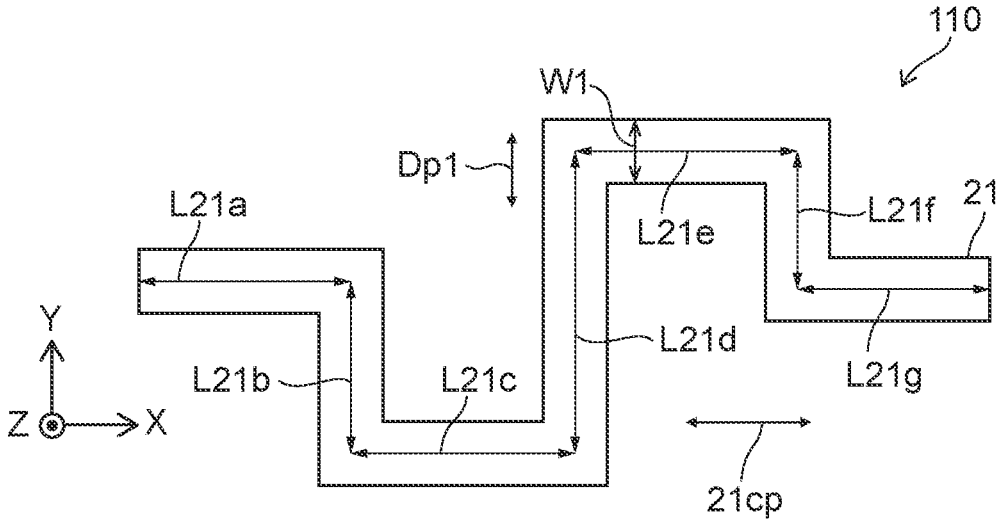
FIGS. 2A and 2B are schematic plan views illustrating portions of the MEMS element according to the first embodiment.
Figure 2B:
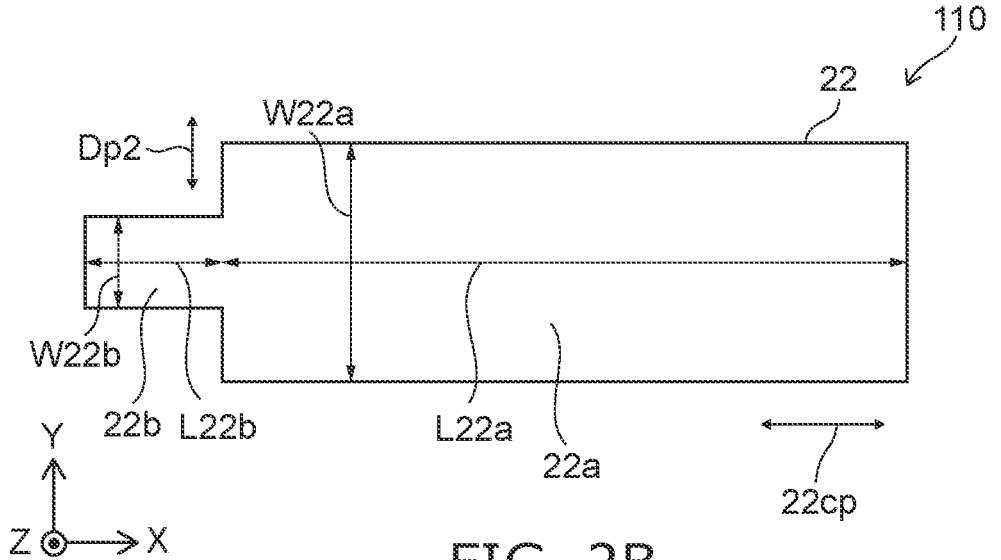

FIGS. 2A and 2B are schematic plan views illustrating portions of the MEMS element according to the first embodiment.

FIG. 1A is a plan view as viewed along arrow AR1 of FIG. 1B. FIG. 1B is a line A1-A2 cross-sectional view of FIG. 1A.

As shown in FIG. 1B, the MEMS element 110 according to the embodiment includes a first member 41 and an element part 51. The first member 41 is, for example, a base body. In the example, the first member 41 includes a substrate 41*s* and an insulating layer 41*i*. The substrate 41*s* is, for example, a silicon substrate. The substrate 41*s* may include a control element such as a transistor, etc. The insulating layer 41*i* is located on the substrate 41*s*. For example, the element part 51 is located on the insulating layer 41*i*. According to the embodiment, the first member 41 may include interconnects, etc, (not illustrated). For example, the interconnects electrically connect the element part 51 and the substrate 41*s*. The interconnects may include contact vias.

As shown in FIGS. 1A and 1B, the element part 51 includes a first fixed electrode 11, a first movable electrode 20E, a first conductive member 21, and a second conductive member 22. The first fixed electrode 11 is fixed to the first member 41. For example, the first fixed electrode 11 is located on the insulating layer 41*i*.

The first movable electrode 20E faces the first fixed electrode 11. The first conductive member 21 is electrically connected to the first movable electrode 20E. The second conductive member 22 is electrically connected to the first movable electrode 20E.

As described below, for example, a first electrical signal Sg1 (referring to FIG. 1B) can be applied between the second conductive member 22 and the first fixed electrode 11. The state before the first electrical signal Sg1 is applied is taken to be a first state (e.g., an initial state). FIGS. 1A and 1B illustrate the first state.

As shown in FIG. 1B, the first movable electrode 20E is supported by the first and second conductive members 21 and 22 to be separated from the first fixed electrode 11 in the first state. For example, a first gap g1 is between the first fixed electrode 11 and the first movable electrode 20E in the first state, For example, a first supporter 21S and a second supporter 22S are provided. The first supporter 21S and the second supporter 22S are fixed to the first member 41. The first supporter 21S and the second supporter 22S are, for example, conductive.

One end of the first conductive member 21 is connected to the first supporter 21S. The first conductive member 21 is supported by the first supporter 21S. The other end of the first conductive member 21 is connected to the first movable electrode 20E. One end of the second conductive member 22 is connected to the second supporter 22S. The second conductive member 22 is supported by the second supporter 22S. The other end of the second conductive member 22 is connected to the first movable electrode 20E. In the example, the first movable electrode 20E is between the first supporter 21S and the second supporter 22S. The first conductive member 21 is between the first supporter 21S and the first movable electrode 20E. In the example, the second conductive member 22 is between the first movable electrode 20E and the second supporter 22S.

As shown in FIG. 1A, for example, the first conductive member 21 is fine-wire-shaped. In the example, the first conductive member 21 has a meandering structure. For example, the first conductive member 21 and the second conductive member 22 are spring members.

According to the embodiment as shown in FIG. 1A, the planar shape of the second conductive member 22 is different from the planar shape of the first conductive member 21.

FIG. 2A is an enlarged illustration of the first conductive member 21. FIG. 2B is an enlarged illustration of the second conductive member 22.

As shown in FIGS. 1A and 2B, for example, the second conductive member 22 includes a first conductive region 22*a* and a second conductive region 22*b*. The second conductive region 22*b* is between the first movable electrode 20E and the first conductive region 22*a*. The direction from the first movable electrode 20E toward the first conductive region 22*a* is taken as a first direction.

The first direction is, for example, an X-axis direction. One direction perpendicular to the X-axis direction is taken as a Y-axis direction. A direction perpendicular to the X-axis direction and the Y-axis direction is taken as a Z-axis direction. For example, the direction from the first fixed electrode 11 toward the first movable electrode 20E is along the Z-axis direction. One direction that crosses the first direction (the X-axis direction) is taken as a second direction Dp2. The second direction Dp2 is, for example, the Y-axis direction. The second direction Dp2 crosses a plane including the first direction (the X-axis direction) and the direction (the Z-axis direction) from the first fixed electrode 11 toward the first movable electrode 20E.

As shown in FIG. 2B, the width along the second direction Dp2 (e.g., the Y-axis direction) of the second conductive member 22 is different by location. The width of the first conductive region 22*a* along the second direction Dp2 (e.g., the Y-axis direction) is taken as a first width W22*a*. The width of the second conductive region 22*b* along the second direction Dp2 is taken as a second width W22*b*. The second width W22*b* is less than the first width W22*a*.

By such a configuration, as described below, a MEMS element can be provided in which a stable operation is possible.

For example, the widths of the first and second conductive members 21 and 22 are less than a width W20 of the first movable electrode 20E (referring to FIG. 1A). The first conductive member 21 and the second conductive member 22 deform more easily than the first movable electrode 20E.

For example, the distance (the length in the Z-axis direction) between the first fixed electrode 11 and the first movable electrode 20E is changeable according to the potential difference between the first fixed electrode 11 and the first movable electrode 20E. The first movable electrode 20E is displaceable when referenced to the first fixed electrode 11.

A first terminal T1 and a second terminal T2 may be provided as shown in FIG. 1B. The first terminal T1 is electrically connected to the first conductive member 21. The second terminal T2 is electrically connected to the second conductive member 22. For example, a current can flow between the first terminal T1 and the second terminal T2 in the first state. At this time, the MEMS element 110 is in a conducting state (e.g., an on-state). As described below, the first conductive member 21 and the second conductive member 22 can be broken. In such a case, a current does not flow between the first terminal T1 and the second terminal T2. At this time, the MEMS element 110 is in a nonconducting state (e.g., an off-state).

In the on-state, for example, a current can flow in a first current path 21*cp* including the first conductive member 21 and the first movable electrode 20E (referring to FIG. 1A). In the on-state, for example, a current can flow in a second current path 22*cp* including the second conductive member 22 and the first movable electrode 20E (referring to FIG. 1A).

The MEMS element 110 can function as a normally-on switch element.

The element part 51 may include a first capacitance element 31 (referring to FIG. 1B). For example, the first capacitance element 31 is electrically connected to the first conductive member 21. In the example, the first capacitance element 31 is electrically connected to the first terminal T1. The electrical connection to the first capacitance element 31 can be controlled by controlling the on-state or the off-state of the element part 51.

As shown in FIG. 1B, for example, a controller 70 may be provided. For example, the controller 70 is electrically connected to a first control terminal Tc1 and the second terminal T2. The first control terminal Tc1 is electrically connected to the first fixed electrode 11. The first electrical signal Sgt can be applied between the second conductive member 22 and the first fixed electrode 11 by the controller 70. The first electrical signal Sgt includes at least one of a voltage signal or a current signal.

For example, the potential of the second conductive member 22 (e.g., the potential of the second terminal T2) is fixed, and the potential of the first fixed electrode 11 is controllable by the controller 70. According to the embodiment, the potential of the first fixed electrode 11 may be substantially fixed, and the potential of the second conductive member 22 may be controllable by the controller 70. Hereinbelow, one example will be described in which the potential of the second conductive member 22 (e.g., the potential of the second terminal T2) is fixed. In such a case, the potential of the first fixed electrode 11 is controlled by the controller 70. The polarity of the potential difference between the second conductive member 22 and the first fixed electrode 11 is arbitrary.

In the first state, the potential of the first movable electrode 20E is substantially equal to the potential of the second conductive member 22. The potential difference between the first fixed electrode 11 and the first movable electrode 20E is changed by changing the potential of the first fixed electrode 11. For example, the distance between the first movable electrode 20E and the first fixed electrode 11 decreases as the potential difference increases. For example, this is based on an electrostatic force. When the potential difference becomes large, the first movable electrode 20E contacts the first fixed electrode 11; and a current can flow in the conductive member via the first movable electrode 20E and the first fixed electrode 11. The conductive member can be broken thereby. The first state before breaking and the second state after breaking can be formed thereby. The phenomenon of the first movable electrode 20E and the first fixed electrode 11 contacting is called "pull-in" or "pull-down". The voltage that generates "pull-in" or "pull-down" is called the "pull-in voltage" or the "pull-down voltage".

For example, the element part 51 of the MEMS element 110 can function as a OTP (One Time Programmable) element.

According to the embodiment as described above, the planar shape of the second conductive member 22 is different from the planar shape of the first conductive member 21. For example, the first conductive member 21 is fine-wire-shaped and has a meandering structure. On the other hand, the second conductive member 22 includes the first conductive region 22*a* and the second conductive region 22*b* such as those described above. Because the planar shape of the second conductive member 22 is different from the planar shape of the first conductive member 21, for example, the rigidity of the first conductive member 21 is less than the rigidity of the second conductive member 22. For example, in such a configuration, the first movable electrode 20E easily changes to a tilted state when the first movable electrode 20E approaches the first fixed electrode 11. The first conductive member 21 can be stably broken thereby, and subsequently, the second conductive member 22 can be stably broken.

An example of a transition from the first state to the second state will now be described.

FIGS. 3A to 4B are schematic cross-sectional views illustrating the MEMS element according to the first embodiment.

These drawings illustrate the change of the element part 51 when the first electrical signal Sg1 is applied between the second conductive member 22 and the first fixed electrode 11. As described above, the first electrical signal Sg1 is supplied by the controller 70.

Figure 3A:
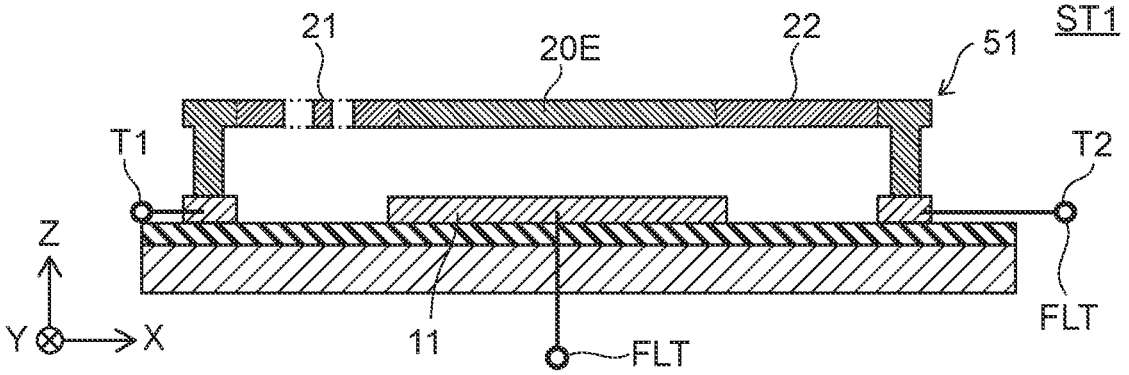
FIGS. 3A to 3C are schematic cross-sectional views illustrating the MEMS element according to the first embodiment.

In the first state ST1 shown in FIG. 3A, the first electrical signal Sg1 is not applied between the second conductive member 22 and the first fixed electrode 11. For example, the second conductive member 22 and the first fixed electrode 11 are in a floating state FLT. At this time, the first movable electrode 20E is separated from the first fixed electrode 11. In such a first state ST1, a current can flow between the first terminal T1 and the second terminal T2. The element part 51 is in the conducting state (the on-state) in the first state ST1. In the first state ST1, the potential difference between the second conductive member 22 and the first fixed electrode 11 may be less than the pull-in voltage.

Figure 3B:
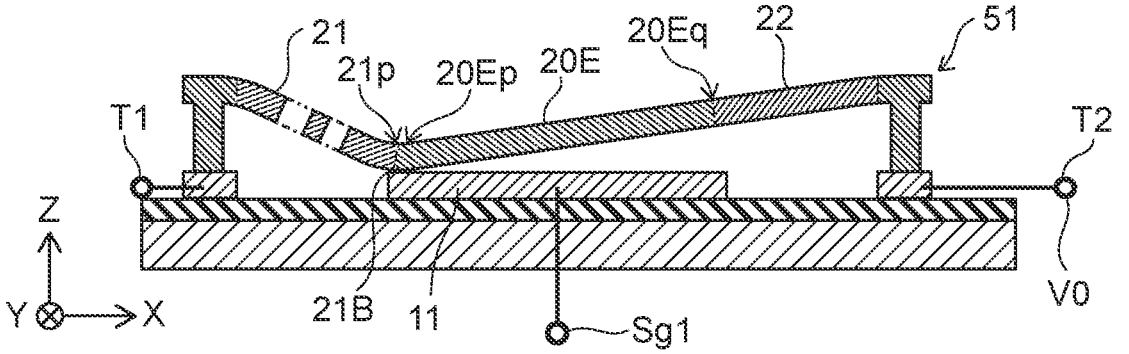

As shown in FIG. 3B, for example, the second terminal T2 (the second conductive member 22) is set to a ground potential V0; and the first electrical signal Sgt is applied to the first fixed electrode 11. Thereby, the first movable electrode 20E is caused to approach the first fixed electrode 11. For example, the first movable electrode 20E tilts easily when the first conductive member 21 and the second conductive member 22 are asymmetric. For example, compared to an end portion 20Eq at the second conductive member 22 side of the first movable electrode 20E, an end portion 20Ep at the first conductive member 21 side of the first movable electrode 20E approaches the first fixed electrode 11. An electric field concentrates at the end portion 20Ep at the first conductive member 21 side of the first movable electrode 20E and at an end portion 21*p* at the first movable electrode 20E side of the first conductive member 21. For example, the end portion 21*p* contacts the first fixed electrode 11. For example, the end portion 20Ep contacts the first fixed electrode 11. Therefore, the temperature easily increases locally at the end portion 20Ep and the end portion 21*p*. For example, the increase of the temperature is due to Joule heat.

The first conductive member 21 breaks when the temperature of at least one of the end portion 20Ep or the end portion 21*p* increases locally. As shown in FIG. 3B, a break portion 216 occurs in the first conductive member 21. The first conductive member 21 is divided at the break portion 216.

For example, as shown in FIG. 1A, a portion of the first conductive member 21 may overlap the first fixed electrode 11 in the Z-axis direction. For example, when a portion of the first conductive member 21 overlaps the first fixed electrode 11 in the Z-axis direction, the portion (the end portion 21*p*) of the first conductive member 21 easily contacts the first fixed electrode 11 when the first movable electrode 20E approaches the first fixed electrode 11. For example, a current locally flows between the first fixed electrode 11 and the portion (the end portion 21*p*) of the first conductive member 21. The first conductive member 21 is more stably broken by the current concentrating at the portion (the end portion 21*p*) of the first conductive member 21. For example, the mechanical rigidity of the first conductive member 21 is less than the mechanical rigidity of the first movable electrode 20E. Thereby, the end portion 21*p* is easily caused to contact the first fixed electrode 11.

Figure 3C:
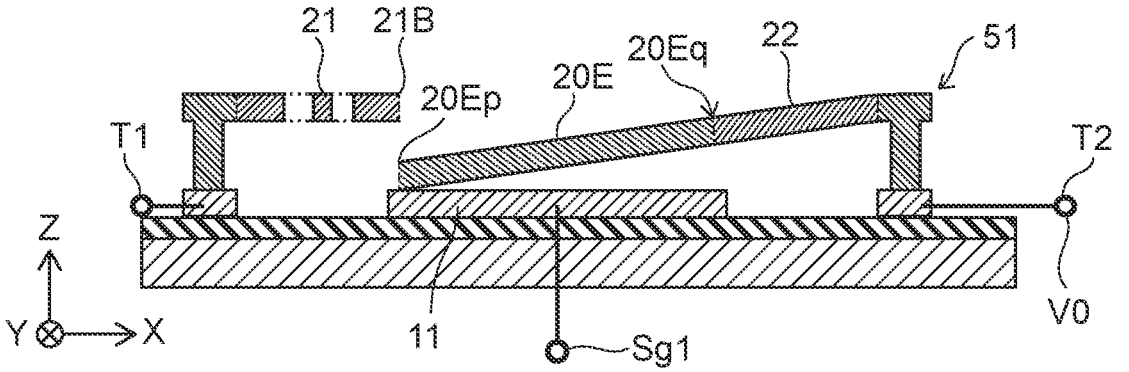

As shown in FIG. 3C, the broken first conductive member 21 may approach the state of FIG. 3A. For example, this is due to the restoring force due to the elasticity of the first conductive member 21. As shown in FIG. 3C, the end portion 20Ep of the first movable electrode 20E is separated from the first conductive member 21.

Figure 4A:
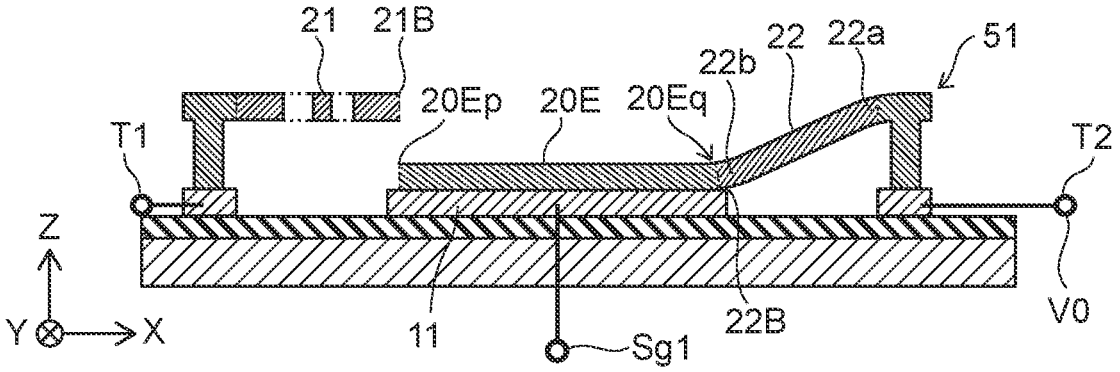
FIGS. 4A and 4B are schematic cross-sectional views illustrating the MEMS element according to the first embodiment.

As shown in FIG. 4A, substantially the entire first movable electrode 20E may contact the first fixed electrode 11 when the application of the first electrical signal Sg1 is continued. This state is, for example, the pull-down state. When the first movable electrode 20E contacts the first fixed electrode 11, there are cases where the first movable electrode 20E is adhered to the first fixed electrode 11; and the first movable electrode 20E substantially does not separate from the first fixed electrode 11.

As shown in FIG. 4A, when the application of the first electrical signal Sg1 is continued, the temperature of a portion (the second conductive region 22*b*) of the second conductive member 22 locally increases, and the second conductive member 22 breaks. For example, the increase of the temperature is due to Joule heat. As described above, the temperature of the second conductive region 22*b* easily increases locally because the second width W22*b* of the second conductive region 22*b* is less than the first width W22*a* of the first conductive region 22*a*. Thereby, a break portion 22B is stably caused to occur at the second conductive region 22*b* or the vicinity of the second conductive region 22*b*. The second conductive member 22 is divided at the break portion 22B. For example, the break portion 22B is formed at the vicinity of the end portion of the second conductive member 22 at the first movable electrode 20E side. The application of the first electrical signal Sg1 ends.

Figure 4B:
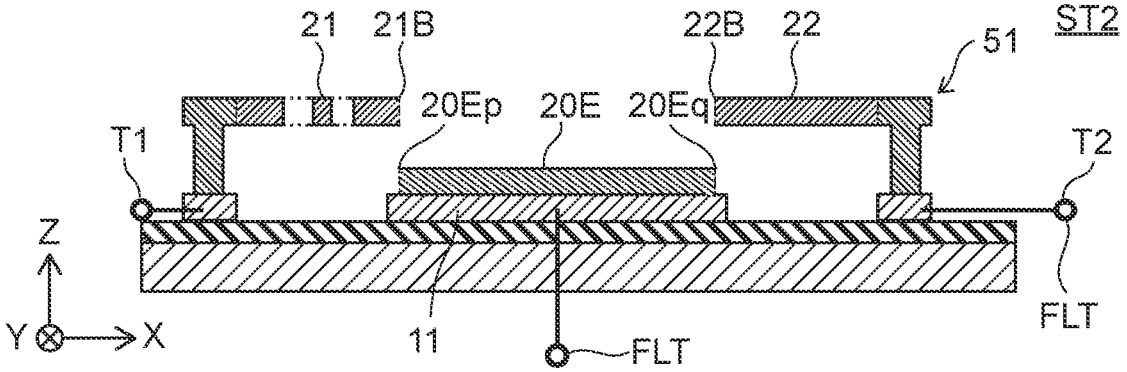

Subsequently, as shown in FIG. 4B, the broken second conductive member 22 may approach the state of FIG. 3A. For example, this is due to the restoring force due to the elasticity of the second conductive member 22. As shown in FIG. 4B, the end portion 20Eq of the first movable electrode 20E is separated from the second conductive member 22.

A second state ST2 shown in FIG. 4B is a state after the first electrical signal Sg1 is applied between the second conductive member 22 and the first fixed electrode 11. For example, in the second state ST2, the first fixed electrode 11 is in, for example, the floating state FLT. The broken states of the first and second conductive members 21 and 22 continue even after the application of the first electrical signal Sg1 has ended. A current does not flow between the first terminal T1 and the second terminal T2 in the second state ST2. The element part 51 is in the nonconducting state (the off-state) in the second state ST2. For example, in the second state ST2, the second conductive member 22 is in, for example, the floating state FLT. Or, in the second state ST2, the potential of the second conductive member 22 may have the potential of a circuit connected to the second conductive member 22.

Thus, according to the embodiment, both the first conductive member 21 and the second conductive member 22 are in a broken state in the second state ST2 after the first electrical signal Sgt is applied between the second conductive member 22 and the first fixed electrode 11. The current that flows between the first terminal T1 and the second terminal T2 can be stably blocked thereby.

A reference example may be considered in which one of the first conductive member 21 or the second conductive member 22 is broken. For example, in a first reference example, the temperature of the end portion 20Eq at the second conductive member 22 side of the first movable electrode 20E becomes greater than the temperature of the end portion 20Ep at the first conductive member 21 side of the first movable electrode 20E when the first electrical signal Sgt is applied to the first fixed electrode 11. For example, this is due to effects of the shapes, the thermal resistances, etc., of the first and second conductive members 21 and 22. In such a case, the second conductive member 22 is broken by the Joule heat due to the current due to the first electrical signal Sg1. On the other hand, the other end (the first terminal T1) of the first conductive member 21 is floating. Therefore, when the first electrical signal Sgt is applied to the first fixed electrode 11, a current does not flow in the first conductive member 21; and the first conductive member 21 is not broken. In such a first reference example as well, the current that flows between the first terminal T1 and the second terminal T2 can be blocked.

In the first reference example after the second conductive member 22 is broken, the first terminal T1 is electrically connected to the first fixed electrode 11 via the first conductive member 21 and the first movable electrode 20E. For example, when a transistor that controls the application of the first electrical signal Sg1 to the first fixed electrode 11 or the like is connected with the first fixed electrode 11, the parasitic capacitance of the transistor remains even after the application of the first electrical signal Sg1 has ended. The parasitic capacitance of the transistor affects the capacitance of the first terminal T1. In the first reference example, such an unnecessary capacitance remains in the element part 51. The remaining capacitance easily causes unstable electrical characteristics of the off-state of the element part 51 functioning as a switch. For example, when the signal of the circuit in which the element part 51 is embedded has a high frequency, the remaining capacitance makes the characteristics of the element part 51 unstable.

According to the embodiment, the first conductive member 21 and the second conductive member 22 are in a broken state in the second state ST2. Therefore, the first terminal T1 is separated from the first fixed electrode 11 and the parasitic capacitance of the transistor. The electrical characteristics of the element part 51 in the off-state are stabilized thereby. Stable off-characteristics can be maintained even for high frequency switching. According to the embodiment, a MEMS element can be provided in which a stable operation is possible.

According to the embodiment, for example, the first conductive member 21 breaks when the first electrical signal Sg1 is applied between the second conductive member 22 and the first fixed electrode 11. Continuing, the second conductive member 22 also is broken by continuing the application of the first electrical signal Sg1. Or, the application of the first electrical signal Sg1 can be ended after the first conductive member 21 has broken and before the second conductive member 22 has broken. However, the first electrical signal Sg1 may not be ended partway because the second conductive member 22 can be broken by continuing the application of the first electrical signal Sg1.

As shown in FIG. 1A, for example, a portion of the meandering structure of the first conductive member 21 may overlap an end portion lip of the first fixed electrode 11 in the direction (the Z-axis direction) from the first fixed electrode 11 toward the first movable electrode 20E. Thereby, breaking is easily caused to occur at the second conductive region 22*b* and the vicinity of the second conductive region 22*b*.

As shown in FIG. 1A, for example, the second conductive region 22*b* overlaps an end portion 11*q* of the first fixed electrode 11 in the direction (the Z-axis direction) from the first fixed electrode 11 toward the first movable electrode 20E. Thereby, breaking is easily caused to occur at the second conductive region 22*b* and the vicinity of the second conductive region 22*b*.

As shown in FIG. 2B, the length of the first conductive region 22*a* along the first direction (the X-axis direction) is taken as a length L22*a*. The length of the second conductive region 22*b* along the first direction (the X-axis direction) is taken as a length L22*b*. In the example, the length L22*b* is less than the length L22*a*. By such a configuration, the second conductive member 22 can stably support the first movable electrode 20E; and the temperature can be efficiently increased locally in the second conductive region 22*b*.

As shown in FIG. 2A, the first conductive member 21 has a first length along the first current path 21*cp* including the first conductive member 21 and the first movable electrode 20E. The first length corresponds to the sum of lengths L21*a* to L21*g*. As shown in FIG. 2B, the second conductive member 22 has a second length along the second current path 22*cp* including the second conductive member 22 and the first movable electrode 20E. For example, the second length corresponds to the sum of the length L22*a* and the length L22*b*. In the example, the second length is less than the first length. In such a case, the rigidity of the first conductive member 21 is less than the rigidity of the second conductive member 22. Therefore, the characteristics of the first conductive member 21 are asymmetric to the characteristics of the second conductive member 22.

As shown in FIG. 2A, the first conductive member 21 has a width W1 along a direction Dp1 crossing the first current path 21*cp*. The width W1 is less than the width W20 of the first movable electrode 20E (referring to FIG. 1A). As shown in FIGS. 1A and 2B, the first width W22*a* along a direction (the second direction Dp2) crossing the second current path 22*cp* of the first conductive region 22*a* of the second conductive member 22 is less than the width W20.

Figure 5:
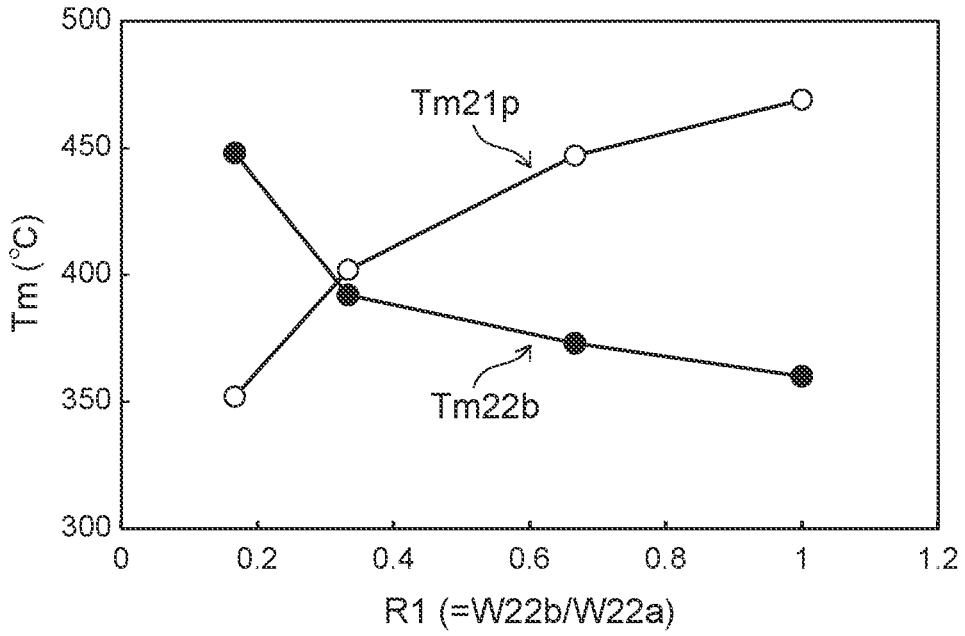
FIG. 5 is a graph illustrating characteristics of the MEMS element.

FIG. 5 is a graph illustrating characteristics of the MEMS element.

FIG. 5 illustrates simulation results of the temperature increases of the first and second conductive members 21 and 22 when the first electrical signal Sg1 is applied between the second conductive member 22 and the first fixed electrode 11. In the simulation, the first conductive member 21 has the meandering structure illustrated in FIGS. 1A and 2A. In the simulation, the first width W22*a* of the first conductive region 22*a* of the second conductive member 22 is constant, and the second width W22*b* of the second conductive region 22*b* of the second conductive member 22 is modified. The horizontal axis of FIG. 5 is a ratio R1 of the second width W22*b* to the first width W22*a*. The vertical axis of FIG. 5 is a temperature Tm. FIG. 5 shows a temperature Tm21*p* of the end portion 21*p* at the first movable electrode 20E side of the first conductive member 21 and a temperature Tm22*b* of the second conductive region 22*b* of the second conductive member 22.

As shown in FIG. 5, the temperature Tm22*b* of the second conductive region 22*b* increases as the ratio R1 decreases. When the ratio R1 is excessively high (e,g., when R1 is 1), the increase of the temperature Tm22*b* of the second conductive region 22*b* is insufficient, and it is difficult to break the second conductive region 22*b*.

On the other hand, when the ratio R1 is low, the temperature Tm21*p* of the end portion 21*p* at the first movable electrode 20E side of the first conductive member 21 decreases. Therefore, the end portion 21*p* does not easily break.

According to the embodiment, for example, the second width W22*b* is not less than 0.1 times the first width W22*a*. For example, it is favorable for the second width W22*b* to be not less than 0.25 times and not more than 0.7 times the first width W22*a*. The second width W22*b* may be not less than 0.33 times and not more than 0.66 times the first width W22*a*. A sufficient increase of the temperature Tm21*p* of the end portion 21*p* and a sufficient increase of the temperature Tm22*b* of the second conductive region 22*b* are obtained thereby. Thereby, a MEMS element can be provided in which a more stable operation is possible, FIG. 6 is a schematic plan view illustrating a portion of a MEMS element according to the first embodiment.

Figure 6:
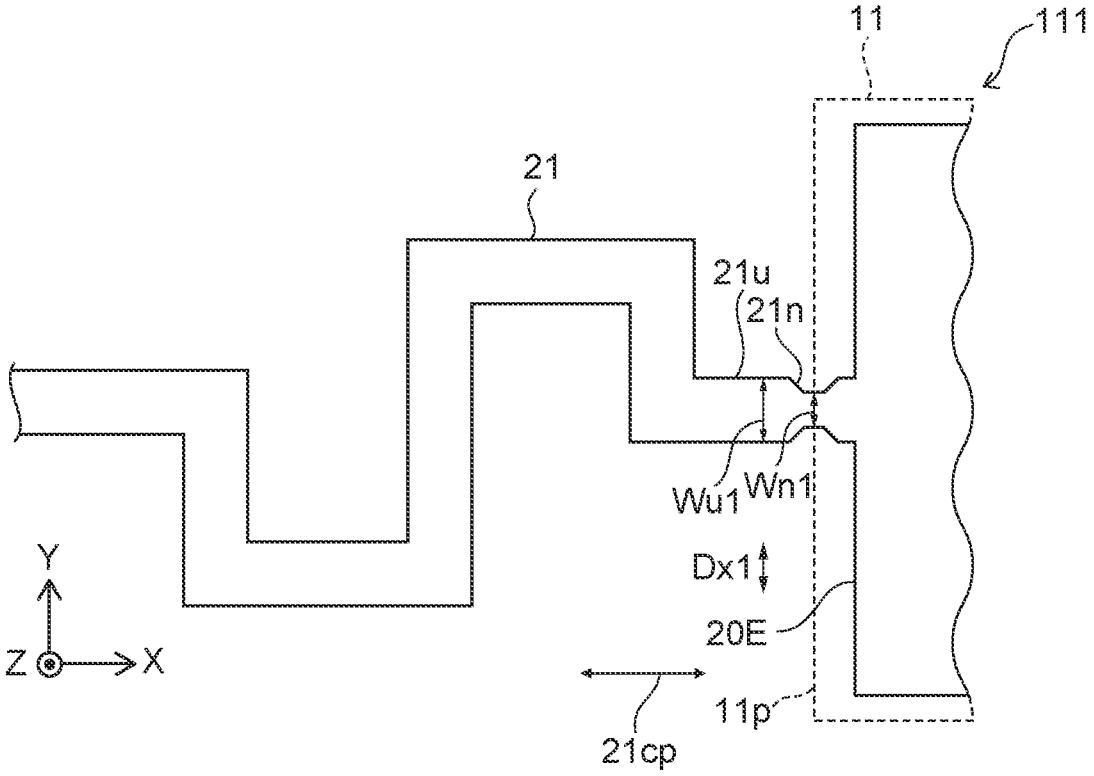
FIG. 6 is a schematic plan view illustrating a portion of a MEMS element according to the first embodiment.

FIG. 6 illustrates the first conductive member 21 of the MEMS element 111 according to the embodiment. Other than the shape of the first conductive member 21, the configuration of the MEMS element 111 may be similar to that of the MEMS element 110.

As shown in FIG. 6, the first conductive member 21 may include a first notch portion 21*n* and a first non-notch portion 21*u*. For example, the direction from the first notch portion 21*n* toward the first non-notch portion 21*u* is along the first current path 21*cp* including the first conductive member 21 and the first movable electrode 20E.

A length Wn1 of the first notch portion 21*n* along a first cross direction Dx1 perpendicular to the first current path 21*cp* is less than a length Wu1 of the first non-notch portion 21*u* along the first cross direction Dx1. The first conductive member 21 is easily broken at the first notch portion 21*n*.

For example, it is favorable for the first notch portion 21*n* to be proximate to the first movable electrode 20E. Thereby, breaking occurs more easily at the first notch portion 21*n* when a portion of the first movable electrode 20E contacts the first fixed electrode 11. The distance between the first notch portion 21*n* and the first movable electrode 20E is short. For example, the distance between the first notch portion 21*n* and the first movable electrode 20E is not more than ½ of the length of the first conductive member 21 along the first current path 21*cp* including the first conductive member 21 and the first movable electrode 20E (the sum of the lengths L21*a* to L21*g* in FIG. 2A). The distance between the first notch portion 21*n* and the first movable electrode 20E may be not more than 1/10 of this length. The distance between the first notch portion 21*n* and the first movable electrode 20E may be not more than 1/20 of this length. The first conductive member 21 breaks more easily.

In the MEMS element 111, the first notch portion 21*n* overlaps the end portion lip of the first fixed electrode 11 in the direction (the Z-axis direction) from the first fixed electrode 11 toward the first movable electrode 20E. Breaking occurs more easily at the first notch portion 21*n*.

Figure 7A:
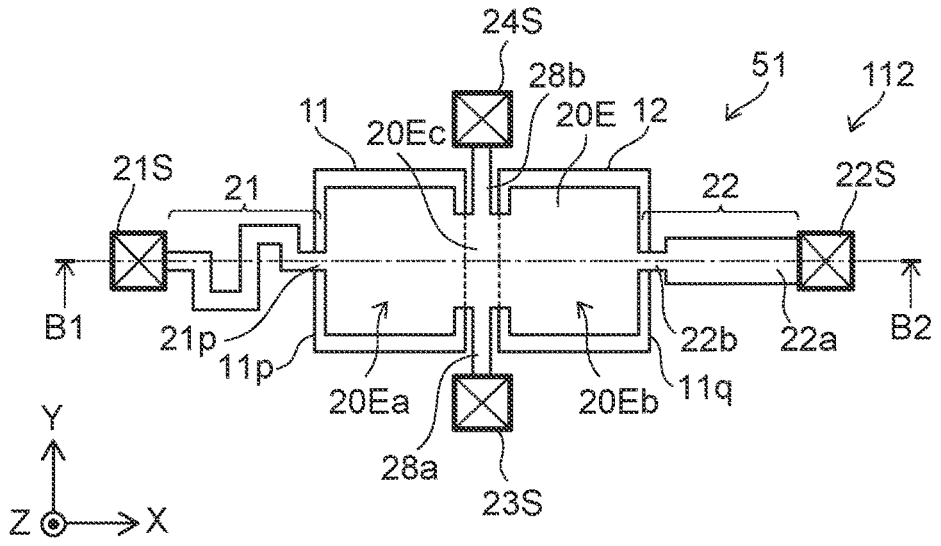
FIGS. 7A and 7B are schematic views illustrating a MEMS element according to the first embodiment.
Figure 7B:
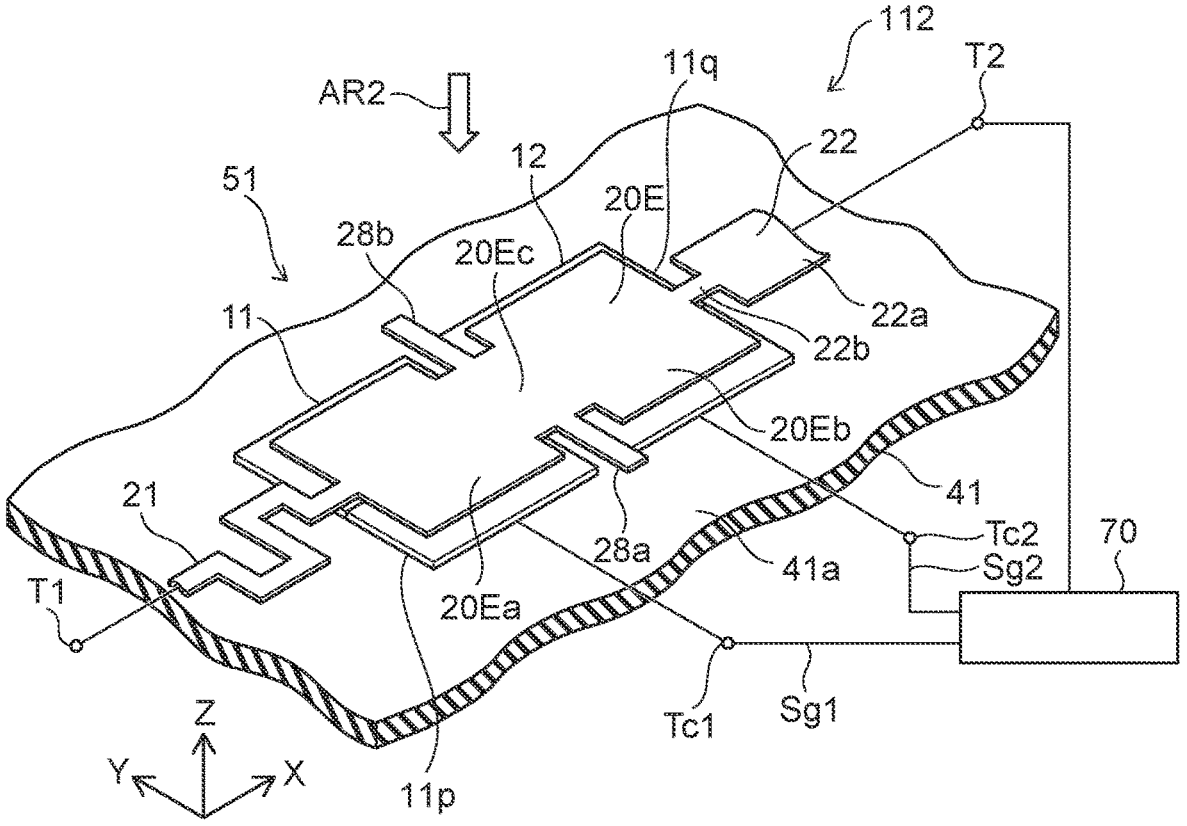

FIGS. 7A and 7B are schematic views illustrating a MEMS element according to the first embodiment.

FIG. 7A is a plan view as viewed along arrow AR2 of FIG. 7B. FIG. 7B is a perspective view.

As shown in FIG. 7B, the MEMS element 112 according to the embodiment also includes the first member 41 and the element part 51. In the MEMS element 112, the element part 51 includes a second fixed electrode 12 in addition to the first fixed electrode 11, the first movable electrode 20E, the first conductive member 21, and the second conductive member 22. The configurations of the first fixed electrode 11, the first movable electrode 20E, the first conductive member 21, and the second conductive member 22 of the MEMS element 112 may be similar to those of the MEMS element 110 or the MEMS element 111. An example of the second fixed electrode 12 will now be described.

As shown in FIG. 7B, the second fixed electrode 12 is fixed to the first member 41. The first movable electrode 20E includes a first electrode region 20Ea and a second electrode region 20Eb, The distance between the first electrode region 20Ea and the first conductive member 21 is less than the distance between the second electrode region 20Eb and the first conductive member 21. The first electrode region 20Ea is at the first conductive member 21 side. The second electrode region 20Eb is at the second conductive member 22 side.

The first electrode region 20Ea faces the first fixed electrode 11. The second electrode region 20Eb faces the second fixed electrode 12.

For example, the controller 70 can be electrically connected to the first fixed electrode 11 via the first control terminal Tc1. The controller 70 can be electrically connected to the second fixed electrode 12 via a second control terminal Tc2. In the example, the controller 70 is electrically connected to the second conductive member 22 via the second terminal T2. For example, a second electrical signal Sg2 can be applied between the second conductive member 22 and the second fixed electrode 12 by the controller 70.

FIG. 7B corresponds to the first state ST1. The first state ST1 is before the second electrical signal Sg2 is applied between the second conductive member 22 and the second fixed electrode 12. In the first state ST1, the first movable electrode 20E is supported by the first and second conductive members 21 and 22 to be separated from the second fixed electrode 12. As described above, in the first state ST1, the first movable electrode 20E is supported by the first and second conductive members 21 and 22 to be separated from the first fixed electrode 11.

The second state ST2 is, for example, after the second electrical signal Sg2 is applied between the second conductive member 22 and the second fixed electrode 12. As described below, the first conductive member 21 and the second conductive member 22 are in a broken state in the second state ST2.

In the example as shown in FIGS. 7A and 7B, the first movable electrode 20E includes a third electrode region 20Ec in addition to the first electrode region 20Ea and the second electrode region 20Eb. The third electrode region 20Ec is between the first electrode region 20Ea and the second electrode region 20Eb.

As shown in FIG. 7A, the element part 51 includes the first supporter 21S, the second supporter 22S, and a third supporter 23S. In the example, the element part 51 further includes a fourth supporter 24S. The first to fourth supporters 21S to 24S are fixed to the first member 41.

At least a portion of the first conductive member 21 is supported by the first supporter 21S to be separated from the first member 41. At least a portion of the second conductive member 22 is supported by the second supporter 22S to be separated from the first member 41. At least a portion of the third electrode region 20Ec is supported by the third supporter 23S to be separated from the first member 41. At least a portion of the third electrode region 20Ec is supported by the fourth supporter 24S to be separated from the first member 41. In the example, the third electrode region 20Ec is between the third supporter 23S and the fourth supporter 24S.

For example, the third electrode region 20Ec may be a portion that includes the X-axis direction center of the first movable electrode 20E. For example, the third electrode region 20Ec is the central portion between the first conductive member 21 and the second conductive member 22. In the MEMS element 112, at least a portion of the third electrode region 20Ec is supported to be separated from the first member 41. Therefore, for example, the distance between the second electrode region 20Eb and the second fixed electrode 12 increases as the distance between the first electrode region 20Ea and the first fixed electrode 11 decreases. Both the first conductive member 21 and the second conductive member 22 easily break more stably.

In the example, the first movable electrode 20E includes a first extension region 28*a*. The first extension region 28*a* extends along an extension direction. The extension direction crosses the direction (in the example, the X-axis direction) from the first electrode region 20Ea toward the second electrode region 20Eb and is along a surface 41*a* of the first member 41. In the example, the extension direction is the Y-axis direction.

A portion (e.g., an end) of the first extension region 28*a* is connected with the third electrode region 20Ec. Another portion (e.g., another end) of the first extension region 28*a* is connected with the third supporter 23S. Thus, at least a portion of the third electrode region 20Ec may be supported by the third supporter 23S via the first extension region 28*a* to be separated from the first member 41.

In the example, the first movable electrode 20E includes a second extension region 28*b*. The third electrode region 20Ec is between the first extension region 28*a* and the second extension region 28*b* in the extension direction (e.g., the Y-axis direction) recited above. At least a portion of the third electrode region 20Ec may be supported by the fourth supporter 24S via the second extension region 28*b* to be separated from the first member 41.

For example, the third supporter 23S and the fourth supporter 24S may be electrically insulated from the first movable electrode 20E. The first electrode region 20Ea, the second electrode region 20Eb, the third electrode region 20Ec, the first extension region 28*a*, and the second extension region 28*b* may be a continuous conductive layer. For example, the first extension region 28*a* and the second extension region 28*b* may function as torsion springs.

As described below, in the MEMS element 112, the first conductive member 21 and the second conductive member 22 can be more stably broken by providing the first fixed electrode 11 and the second fixed electrode 12. A MEMS element can be provided in which a stable operation is possible.

FIGS. 8A to 9C are schematic cross-sectional views illustrating the MEMS element according to the first embodiment. These drawings correspond to a line B1-B2 cross section of FIG. 7A.

Figure 8A:
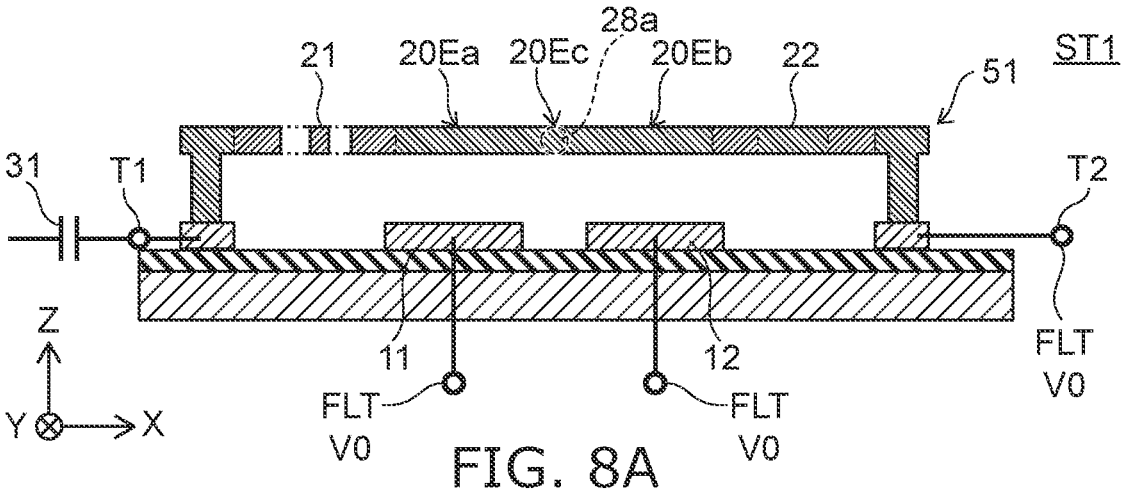
FIGS. 8A to 8C are schematic cross-sectional views illustrating the MEMS element according to the first embodiment.

In the first state ST1 shown in FIG. 8A, for example, the second conductive member 22, the first fixed electrode 11, and the second fixed electrode 12 are set to the floating state FLT or the ground potential V0. In the first state ST1, the element part 51 is in the conducting state (the on-state).

Figure 8B:
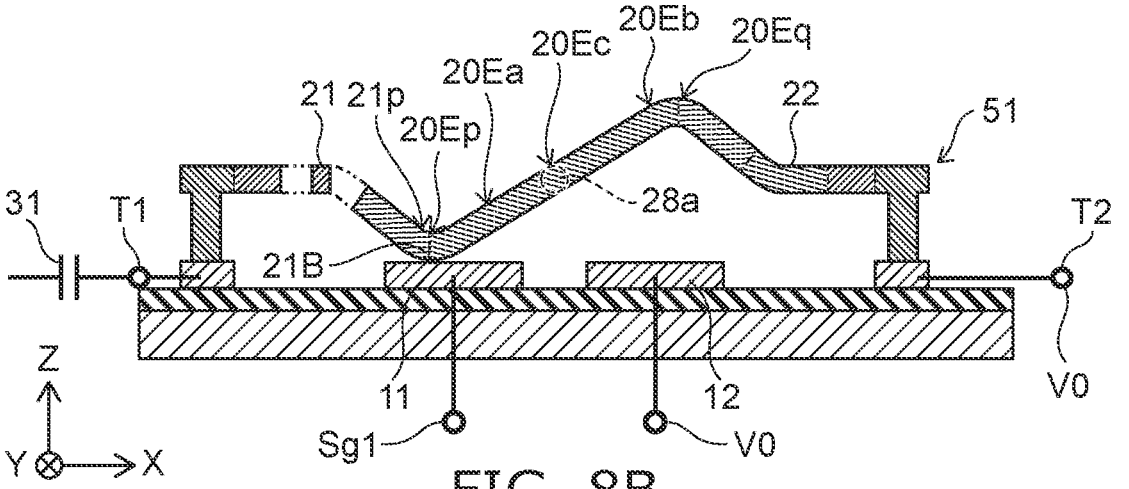

As shown in FIG. 8B, for example, the second terminal 12 (the second conductive member 22) is set to the ground potential V0; and the first electrical signal Sg1 is applied to the first fixed electrode 11. The first electrode region 20Ea contacts the first fixed electrode 11. Because the third electrode region 20Ec is supported via the first extension region 28*a* to be separated from the first member 41, the distance between the second electrode region 20Eb and the second fixed electrode 12 increases. The temperature of the first conductive member 21 at the vicinity of the end portion 20Ep of the first movable electrode 20E easily increases locally. The temperature of the end portion 21*p* at the first movable electrode 20E side of the first conductive member 21 locally increases.

When the temperature of the end portion 20Ep and the end portion 21*p* locally increases, the first conductive member 21 breaks; and the break portion 21B is formed as shown in FIG. 8B.

Figure 8C:
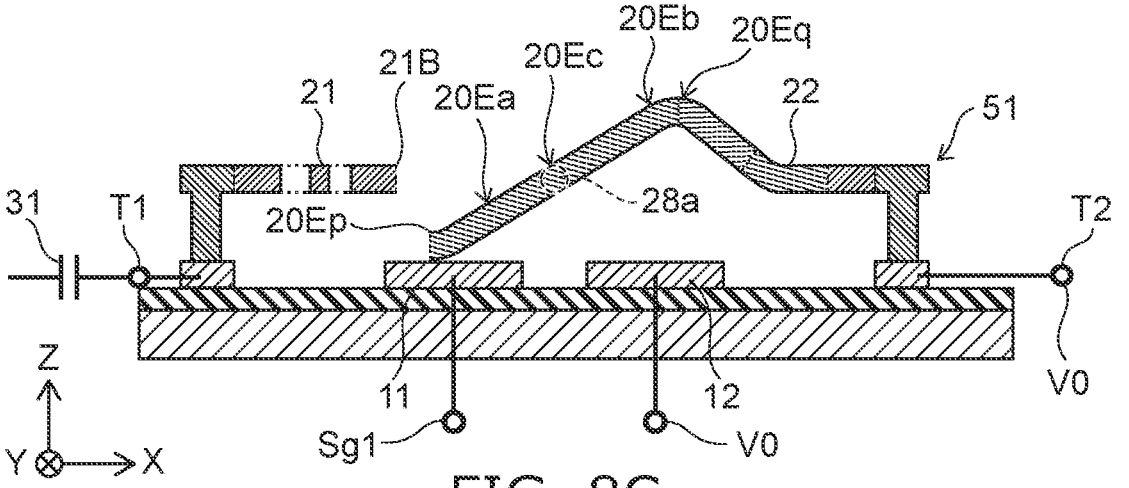

As shown in FIG. 8C, the broken first conductive member 21 may approach the state of FIG. 8A due to the restoring force due to the elasticity of the first conductive member 21.

Figure 9A:
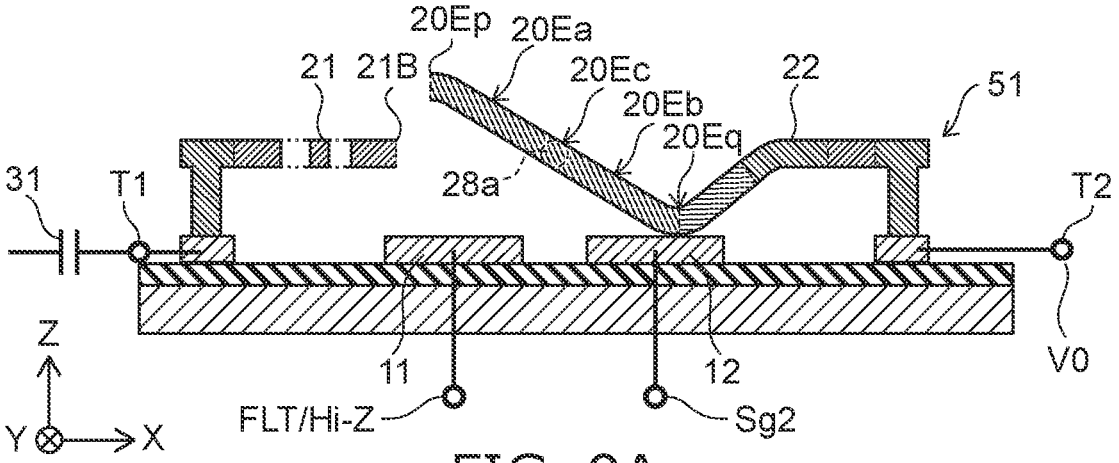
FIGS. 9A to 9C are schematic cross-sectional views illustrating the MEMS element according to the first embodiment.

As shown in FIG. 9A, for example, the second terminal T2 (the second conductive member 22) is set to the ground potential V0; and the second electrical signal Sg2 is applied to the second fixed electrode 12. At this time, for example, the first fixed electrode 11 is set to the ground potential V0 or a high-impedance state Hi-Z. The temperature of the second conductive member 22 increases, and the second conductive member 22 breaks. The second conductive member 22 is divided at the break portion 22B. The application of the second electrical signal Sgt ends.

Figure 9B:
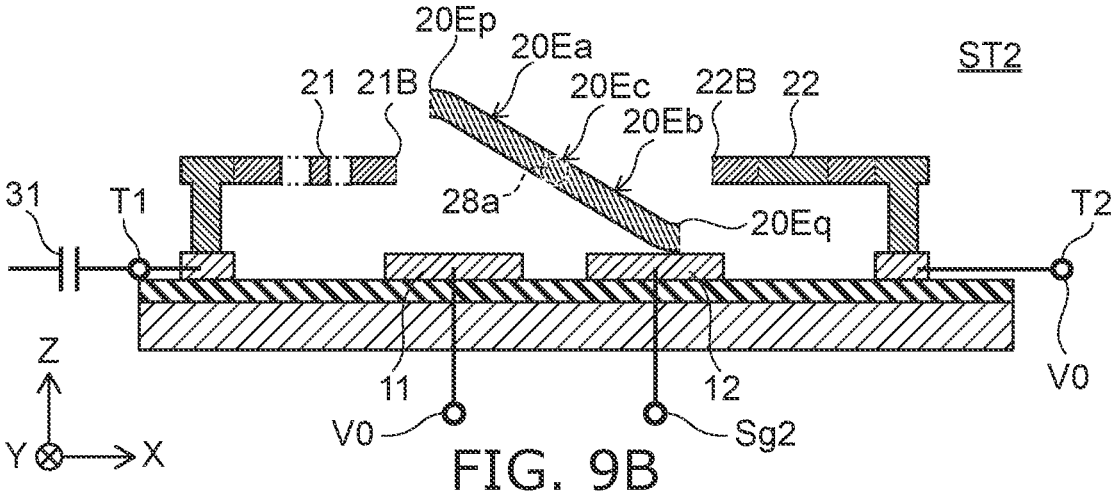

As shown in FIG. 9B, the broken second conductive member 22 may approach the state of FIG. 9A due to the restoring force due to the elasticity of the second conductive member 22.

Figure 9C:
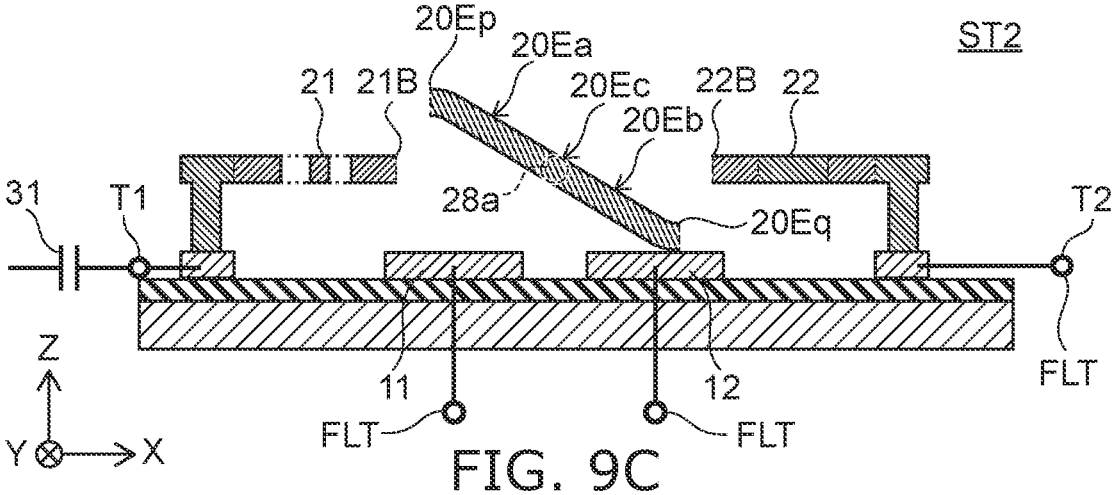

In the second state ST2 shown in FIG. 9C, for example, the second conductive member 22, the first fixed electrode 11, and the second fixed electrode 12 are in the floating state FLT. In the second state ST2, the element part 51 is in the nonconducting state (the off-state).

In the MEMS element 112, both the first conductive member 21 and the second conductive member 22 easily break in the second state ST2. The current that flows between the first terminal T1 and the second terminal T2 can be stably blocked.

Figure 10A:
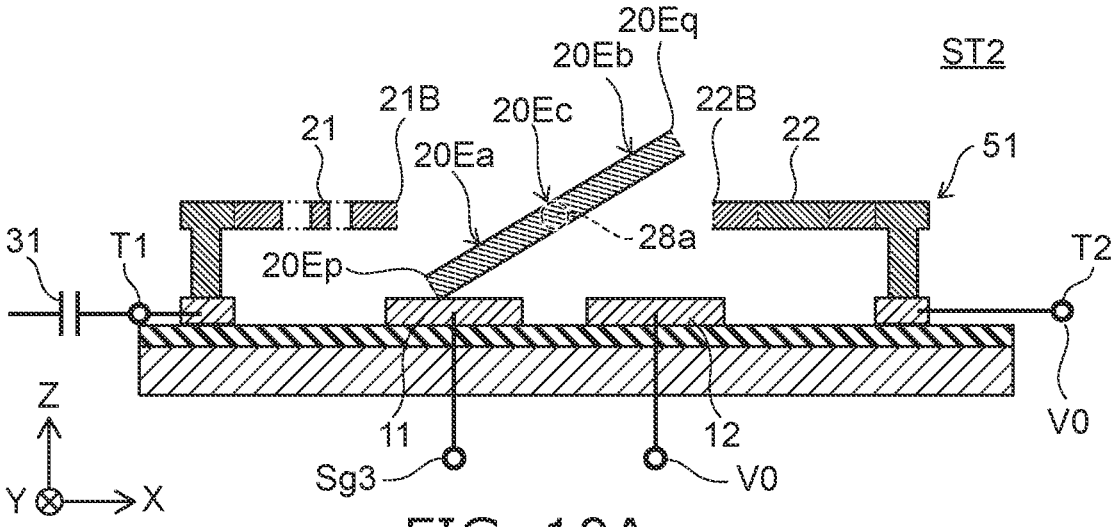
FIGS. 10A and 10B are schematic cross-sectional views illustrating the MEMS element according to the first embodiment.
Figure 10B:
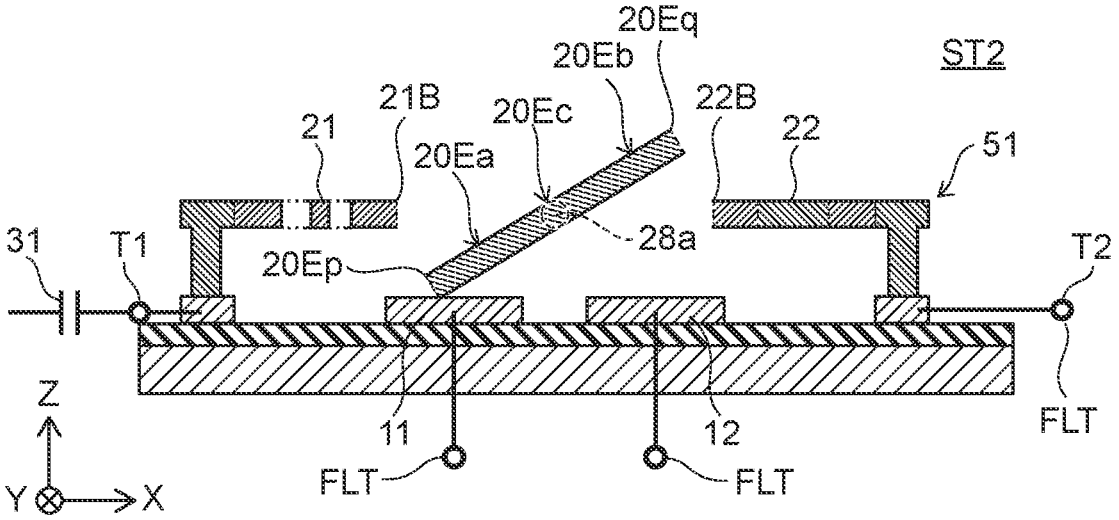

FIGS. 10A and 10B are schematic cross-sectional views illustrating the MEMS element according to the embodiment.

These drawings illustrate another operation of the MEMS element 112. These drawings illustrate an operation after the operation described in reference to FIGS. 8A to 8C is performed.

As shown in FIG. 10A, for example, the second terminal T2 (the second conductive member 22) is set to the ground potential V0; and a third electrical signal Sg3 is applied to the first fixed electrode 11. For example, the absolute value of the third electrical signal Sg3 is greater than the absolute value of the first electrical signal Sg1. The second conductive member 22 is broken thereby. As shown in FIG. 10A, the broken second conductive member 22 may approach the state of FIG. 8C due to the restoring force due to the elasticity of the second conductive member 22.

In the second state ST2 shown in FIG. 10B, for example, the second conductive member 22, the first fixed electrode 11, and the second fixed electrode 12 are in the floating state FLT. In the second state ST2, the element part 51 is in the nonconducting state (the off-state).

The configuration in which at least a portion of the third electrode region 20Ec is supported to be separated from the first member 41 is applicable to a configuration in which the second fixed electrode 12 is not provided. For example, the third electrode region 20Ec, the first extension region 28*a*, the second extension region 28*b*, the third supporter 23S, the fourth supporter 24S, etc., described in reference to the MEMS element 112 (referring to FIG. 7A) may be provided in the MEMS element 110 illustrated in FIGS. 1A and 1B.

In the MEMS element 112, the third electrode region 20Ec, the third supporter 23S, and the fourth supporter 24S may not be provided, and the second fixed electrode 12 may be provided in addition to the first fixed electrode 11. In such a case, the operation relating to FIGS. 8A to 10B can be performed because separate voltages can be applied to the first and second fixed electrodes 11 and 12. A MEMS element can be provided in which a stable operation is possible.

Second Embodiment

Figure 11A:
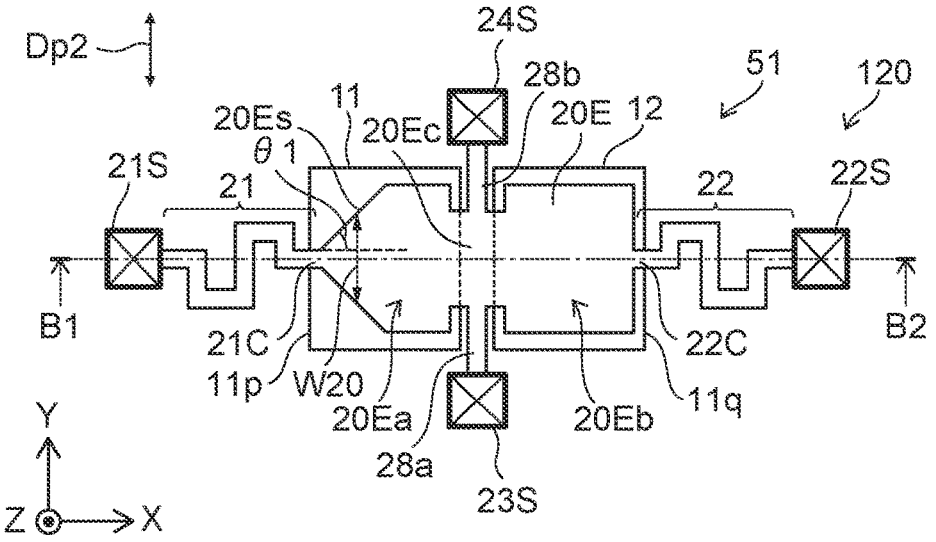
FIGS. 11A and 11B are schematic views illustrating a MEMS element according to a second embodiment.
Figure 11B:
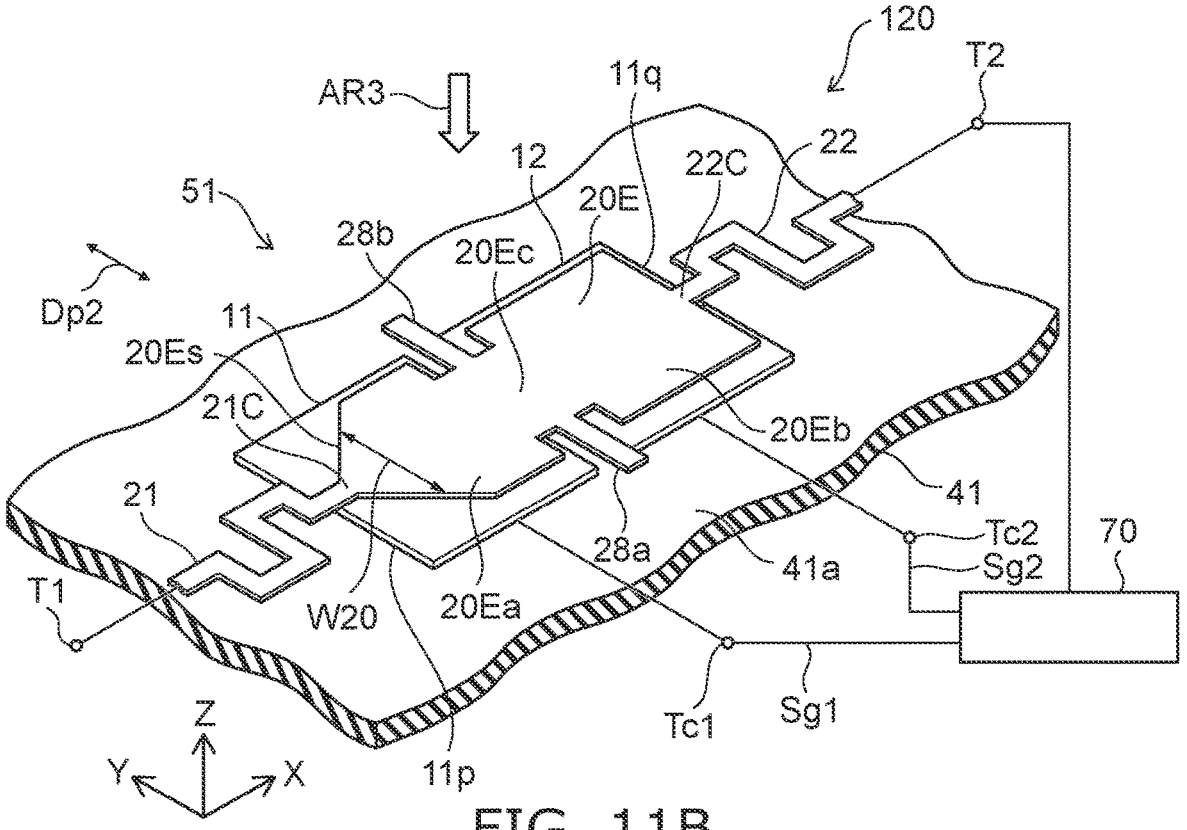

FIGS. 11A and 11B are schematic views illustrating a MEMS element according to a second embodiment.

FIG. 11A is a plan view as viewed along arrow AR3 of FIG. 11B, FIG. 11B is a perspective view.

As shown in FIG. 11B, the MEMS element 120 according to the embodiment also includes the first member 41 and the element part 51. In the MEMS element 120, the element part 51 includes the first fixed electrode 11, the first movable electrode 20E, the first conductive member 21, and the second conductive member 22. In the example, the element part 51 includes the second fixed electrode 12. The first movable electrode 20E is supported by the first and second conductive members 21 and 22 to be separated from the first fixed electrode 11.

In the MEMS element 120 as shown in FIGS. 11A and 11B, the width in the Y-axis direction of the first movable electrode 20E continuously changes. Otherwise, the configuration of the MEMS element 120 may be similar to the configurations of the MEMS elements 110 to 112. In the MEMS element 120, the first conductive member 21 and the second conductive member 22 may have meandering structures.

For example, in the MEMS element 120 as shown in FIG. 11A, the first movable electrode 20E may further include the third electrode region 20Ec between the first electrode region 20Ea and the second electrode region 20Eb. In the example, the element part 51 includes the first to fourth supporters 21S to 24S. These supporters are fixed to the first member 41. At least a portion of the first conductive member 21 is supported by the first supporter 21S to be separated from the first member 41. At least a portion of the second conductive member 22 is supported by the second supporter 22S to be separated from the first member 41. At least a portion of the third electrode region 20Ec is supported by the third supporter 23S to be separated from the first member 41. At least a portion of the third electrode region 20Ec is supported by the fourth supporter 24S to be separated from the first member 41. The third electrode region 20Ec is between the third supporter 23S and the fourth supporter 24S.

An example of the first movable electrode 20E of the MEMS element 120 will now be described.

As shown in FIGS. 11A and 11B, the first movable electrode 20E includes a first connection part 21C and a second connection part 22C. The first connection part 21C is connected with the first conductive member 21. The second connection part 22C is connected with the second conductive member 22.

The direction from the first connection part 21C toward the second connection part 22C is taken as the first direction (the X-axis direction). A direction that crosses the first direction is taken as the second direction Dp2. The second direction Dp2 is, for example, the Y-axis direction. A width E20 of the first movable electrode 20E along the second direction Dp2 increases in the orientation from the first connection part 21C toward the second connection part 22C in at least a portion of the first movable electrode 20E. For example, the width W20 continuously increases in the orientation from the first connection part 21C toward the second connection part 22C in at least a portion of the first movable electrode 20E.

For example, the at least a portion of the first movable electrode 20E includes a side portion 20Es. The side portion 20Es is oblique to the first direction (the X-axis direction). By providing such a side portion 20Es, the width E20 continuously increases in the orientation from the first connection part 21C toward the second connection part 22C.

For example, the side portion 20Es described above is provided in at least a portion of the first electrode region 20Ea.

It was found that the temperature of the first connection part 21C (or the first conductive member 21) can be effectively caused to locally increase by such a configuration. The first conductive member 21 and the first connection part 21C can be stably broken thereby. A MEMS element can be provided in which a stable operation is possible.

As shown in FIG. 11A, the angle between the side portion 20Es and the first direction (the X-axis direction) is taken as an angle θ1. In the MEMS element 120, the angle θ1 is, for example, not less than 5 degrees and not more than 85 degrees. As described below, the angle θ1 may be not more than 62 degrees. For example, the angle θ1 may be not less than 39 degrees and not more than 62 degrees.

Figure 12A:
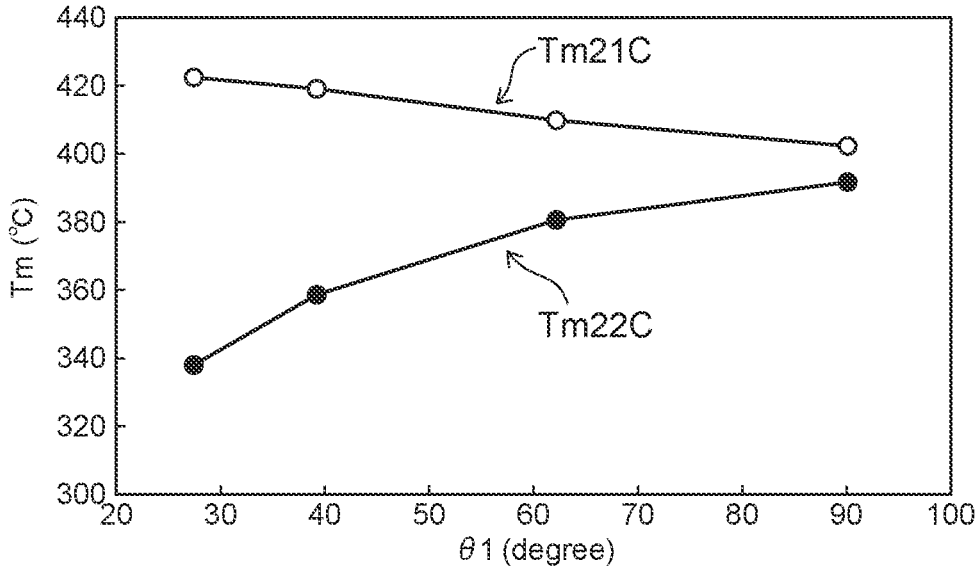
FIGS. 12A and 12B are graphs illustrating characteristics of the MEMS element.
Figure 12B:
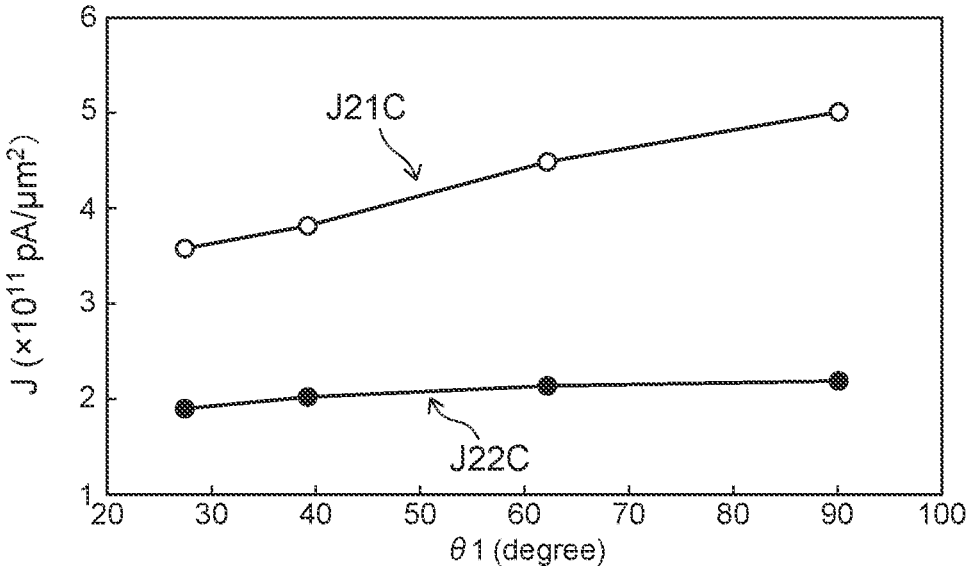

FIGS. 12A and 12B are graphs illustrating characteristics of the MEMS element.

FIG. 12A illustrates simulation results of the temperature increase when the angle θ1 is modified. In the simulation, the first conductive member 21 and the second conductive member 22 have meandering structures. In the simulation, the angle θ1 of the side portion 20Es is modified. The horizontal axis of FIG. 12A is the angle θ1. The vertical axis of FIG. 12A is the temperature Tm. FIG. 12A shows a temperature Tm21C of the first connection part 21C and a temperature Tm22C of the second connection part 22C.

As shown in FIG. 12A, as the angle θ1 decreases, the temperature Tm21C of the first connection part 21C increases and the first connection part 21C (or the first conductive member 21) easily breaks. When the angle θ1 is excessively small, the increase of the temperature Tm22C of the second connection part 22C is insufficient, and the second connection part 22C (or the second conductive member 22) does not easily break. It is favorable for the angle θ1 to be not less than 39 degrees and not more than 70 degrees. The angle θ1 may be not less than 39 degrees and not more than 62 degrees. A MEMS element can be provided in which a more stable operation is possible.

FIG. 12B illustrates simulation results of the current density when the angle θ1 is modified. The horizontal axis of FIG. 12B is the angle θ1. The vertical axis of FIG. 12A is a current density J. FIG. 12B shows a current density J21C in the first connection part 21C and a current density J22C in the second connection part 22C. As shown in FIG. 12A, the current density J21C in the first connection part 21C decreases as the angle θ1 decreases. It is considered that the temperature Tm21C of the first connection part 21C increases as the angle θ1 decreases because the effect of the thermal resistance increasing as the angle θ1 decreases is large.

In the MEMS element 120 as shown in FIG. 11A, in addition to the first fixed electrode 11, the element part 51 may further include the second fixed electrode 12 that is fixed to the first member 41. The first movable electrode 20E includes the first electrode region 20Ea and the second electrode region 20Eb. The distance between the first electrode region 20Ea and the first conductive member 21 is less than the distance between the second electrode region 20Eb and the first conductive member 21. The first electrode region 20Ea faces the first fixed electrode 11. The second electrode region 20Eb faces the second fixed electrode 12. The first movable electrode 20E is supported by the first and second conductive members 21 and 22 to be separated from the second fixed electrode 12.

In the MEMS element 120, the first conductive member 21 may include the first notch portion 21*n* and the first non-notch portion 21*u* (referring to FIG. 6). For example, the direction from the first notch portion 21*n* toward the first non-notch portion 21*u* is along the first current path 21*cp* including the first conductive member 21 and the first movable electrode 20E (referring to FIG. 6). The length Wn1 of the first notch portion 21*n* along the first cross direction Dx1 perpendicular to the first current path 21*cp* is less than the length Elul of the first non-notch portion 21*u* along the first cross direction Dx1 (referring to FIG. 6). The first conductive member 21 easily breaks at the first notch portion 21*n*. The first notch portion 21*n* may overlap the end portion lip of the first fixed electrode 11 in the direction (the Z-axis direction) from the first fixed electrode 11 toward the first movable electrode 20E (referring to FIG. 6). Breaking occurs more easily at the first notch portion 21*n*.

Figure 13:
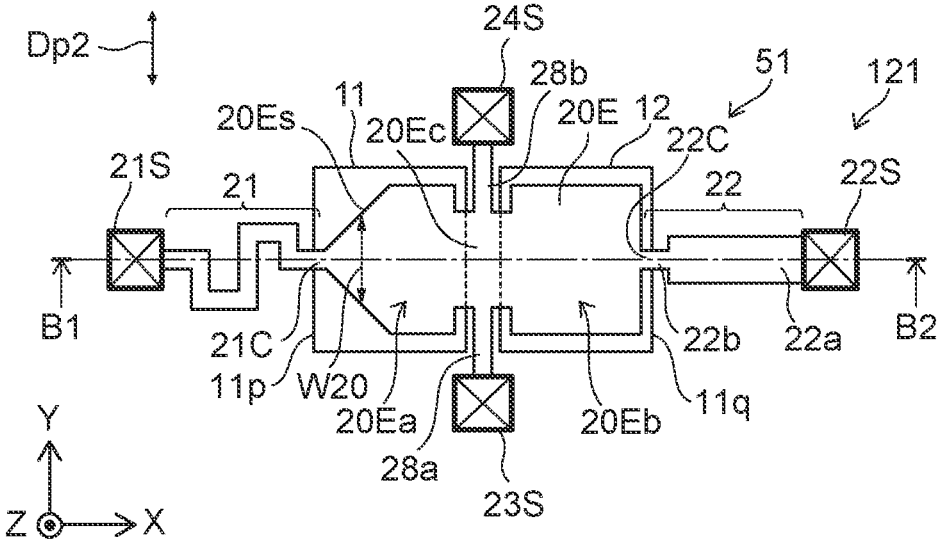
FIG. 13 is a schematic plan view illustrating a MEMS element according to the second embodiment.

FIG. 13 is a schematic cross-sectional view illustrating a MEMS element according to the second embodiment.

As shown in FIG. 13, in the MEMS element 121 according to the embodiment as well, the width 120 increases in the orientation from the first connection part 21C toward the second connection part 22C in at least a portion of the first movable electrode 20E. For example, the width W20 continuously increases in the orientation from the first connection part 21C toward the second connection part 22C in at least a portion of the first movable electrode 20E. For example, the at least a portion of the first movable electrode 20E includes the side portion 20Es, The side portion 20Es is oblique to the first direction (the X-axis direction). In the MEMS element 121, the first conductive member 21 has a meandering structure. The second conductive member 22 includes the first conductive region 22*a* and the second conductive region 22*b*. The second conductive region 22*b* is between the first movable electrode 20E and the first conductive region 22*a*. As described in reference to FIG. 2B, the second width W22*b* of the second conductive region 22*b* along the second direction Dp2 is less than the first width W22*a* of the first conductive region 22*a* along the second direction Dp2. By such a configuration, for example, breaking occurs more easily at the second conductive region 22*b*. As described in reference to FIG. 1A, the second conductive region 22*b* may overlap the end portion 11*q* of the first fixed electrode 11 in the direction (the Z-axis direction) from the first fixed electrode 11 toward the first movable electrode 20E. Breaking occurs more easily.

According to the first and second embodiments, it is favorable for the electrical resistances of the first and second conductive members 21 and 22 to be, for example, not more than 10Ω. Because the electrical resistance is low, a signal that includes high frequencies can be efficiently transmitted with low loss.

According to the first and second embodiments, for example, at least one of the first conductive member 21 or the second conductive member 22 includes at least one selected from the group consisting of Al, Cu, Au, Ti, Pd, Pt, and W. A low resistance is obtained, and good transmission in the element part 51 is obtained.

Figure 14:
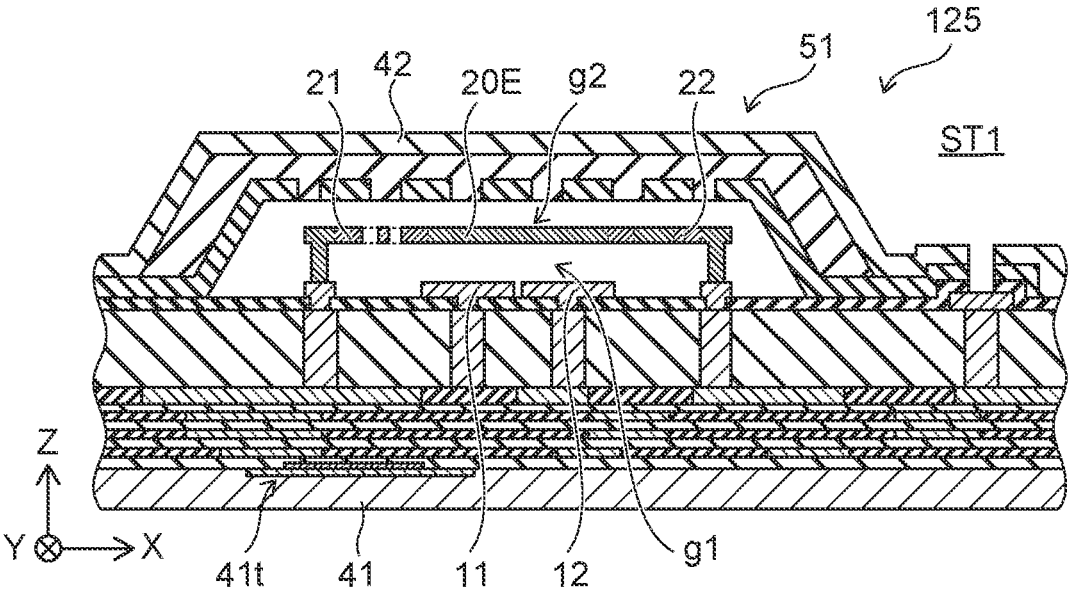
FIG. 14 is a schematic cross-sectional view illustrating a MEMS element according to the second embodiment.

FIG. 14 is a schematic cross-sectional view illustrating a MEMS element according to the embodiment.

FIG. 14 illustrates the MEMS element 125 according to the embodiment. FIG. 14 illustrates the first state ST1. As shown in FIG. 14, the MEMS element 125 further includes a second member 42 in addition to the first member 41 and the element part 51. The first fixed electrode 11 and the first movable electrode 20E are between the first member 41 and the second member 42. In the first state ST1, the first gap g1 is between the first fixed electrode 11 and the first movable electrode 20E. In the first state ST1, a second gap g2 is between the first movable electrode 20E and the second member 42. The element part 51 of the MEMS element 125 may have the configuration described in reference to the first or second embodiment.

The second member 42 is, for example, a cap. The first movable electrode 20E can be displaced along the Z-axis direction due to the first and second gaps g1 and g2. For example, the first gap g1 and the second gap g2 may be in a reduced-pressure state. For example, an inert gas may be introduced to the first and second gaps g1 and g2.

For example, the first member 41 may include a control circuit part 41*t*. The control circuit part 41*t* includes, for example, a switching element such as a transistor, etc. The application of the first electrical signal Sg1 to the first fixed electrode 11 may be controlled by the control circuit part 41*t*.

Third Embodiment

Figure 15:
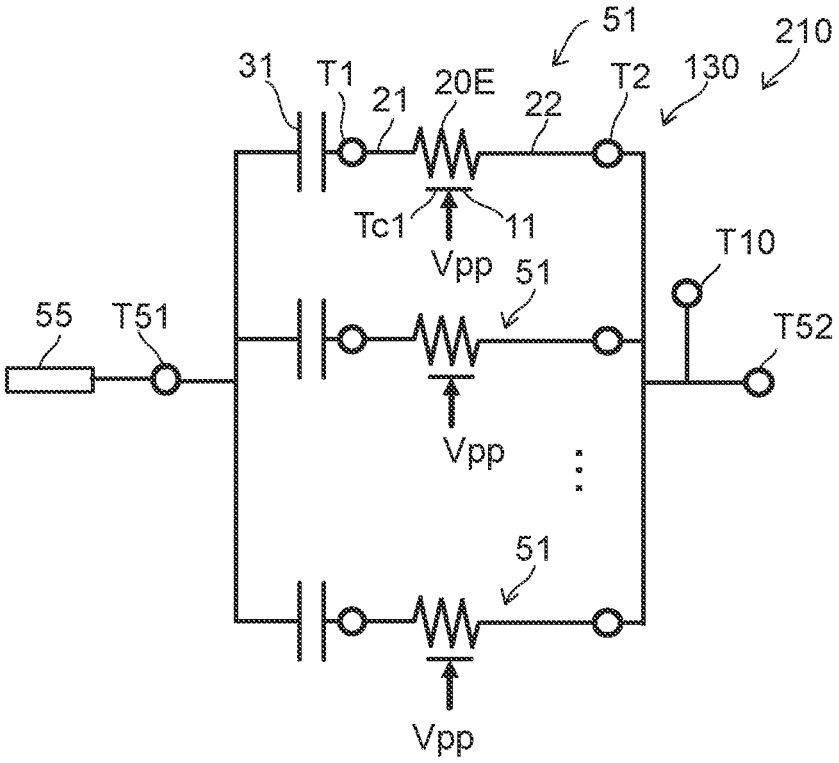
FIG. 15 is a schematic view illustrating a MEMS element including multiple element parts according to a third embodiment.

FIG. 15 is a schematic view illustrating a MEMS element according to a third embodiment.

As shown in FIG. 15, the MEMS element 130 according to the embodiment includes multiple element parts 51. For example, the multiple element parts 51 are connected in parallel. Control signals Vpp can be independently applied to the multiple element parts 51.

For example, the first conductive member 21 and the second conductive member 22 that are included in one of the multiple element parts 51 are breakable independently of the first and second conductive members 21 and 22 included in another one of the multiple element parts 51.

Multiple first capacitance elements 31 are provided in the example. One of the multiple first capacitance elements 31 is connected in series to one of the multiple element parts 51. The MEMS element 130 is a capacitance element array that includes the multiple element parts 51 and the multiple first capacitance elements 31. Several of the multiple element parts 51 can be set to the off-state. The electrical capacitance of the MEMS element 130 can be modified by setting several of the multiple element parts 51 to the off-state.

Fourth Embodiment

A fourth embodiment relates to an electrical circuit. FIG. 15, which is described above, illustrates the configuration of the electrical circuit 210 according to the embodiment. As shown in FIG. 15, the electrical circuit 210 includes a MEMS element (e.g., the MEMS element 130) according to the first to third embodiments and an electrical element 55. The electrical element 55 is electrically connected to the MEMS element 130. The electrical element 55 includes at least one selected from the group consisting of a resistance, a capacitance element, an inductor element, a diode, and a transistor. The capacitance element that is included in the electrical dement 55 may include a sensor. For example, the electrical element 55 may include a sensor element. For example, the electrical dement 55 may include a capacitive sensor dement.

In the electrical circuit 210, the MEMS dement (e.g., the MEMS element 130) may include multiple element parts 51. The characteristics of the electrical circuit 210 are controllable by breaking the first conductive member 21 and the second conductive member 22 included in at least one of the multiple dement parts 51.

For example, when the MEMS element 130 includes the first capacitance dement 31, the electrical capacitance of the MEMS element 130 can be controlled by breaking the first conductive member 21 and the second conductive member 22 included in at least one of the multiple dement parts 51. As a result, the characteristics of the electrical circuit 210 are controllable.

For example, the electrical circuit 210 may be used in a voltage-controlled oscillator (VCO). For example, the electrical circuit 210 may be used in an impedance matching circuit of a high frequency circuit such as an antenna, etc. For example, the electrical circuit 210 may be used in a passive RF tag. For example, the characteristics of the electrical circuit 210 can be appropriately adjusted by adjusting an electrical capacitance or an inductor of the electrical circuit 210. For example, a voltage-controlled oscillator (VCO) that has stable characteristics is obtained. For example, stable characteristics are obtained in the impedance matching circuit of a high frequency circuit such as an antenna, etc. For example, a passive RF tag or the like that has stable characteristics is obtained.

Figure 16:
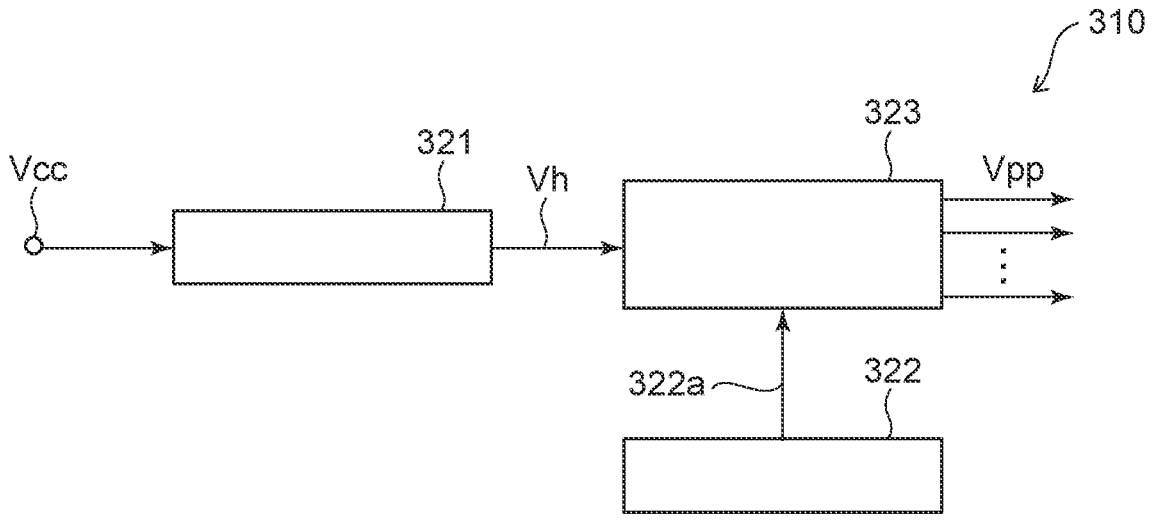
FIG. 16 is a schematic view illustrating a control circuit used in the MEMS element according to the third embodiment.
Figure 17:
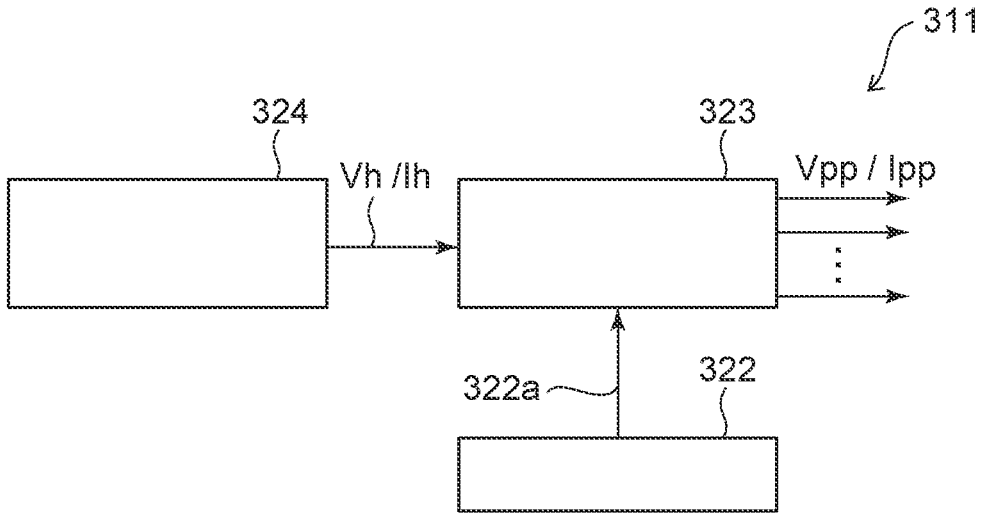
FIG. 17 is a schematic view illustrating a control circuit used in the MEMS element according to the third embodiment.

FIGS. 16 and 17 are schematic views illustrating control circuits used in the MEMS element according to the embodiment.

As shown in FIG. 16, a control circuit 310 includes a voltage step-up circuit 321, a logic circuit 322, and a switching matrix 323. A power supply voltage Vcc is supplied to the voltage step-up circuit 321. The voltage step-up circuit 321 outputs a high voltage Vh to the switching matrix 323. The switching matrix 323 outputs multiple control signals Vpp according to a signal 322*a* supplied from the logic circuit 322 to the switching matrix 323. One of the multiple control signals Vpp is supplied to one of the multiple element parts 51.

As shown in FIG. 17, a control circuit 311 includes a control power supply 324, the logic circuit 322, and the switching matrix 323. The control power supply 324 is, for example, a control voltage source or a control current source. The control power supply 324 outputs, to the switching matrix 323, the high voltage Vh and a large current Ih. The switching matrix 323 outputs the multiple control signals Vpp according to the signal 322*a* supplied from the logic circuit 322 to the switching matrix 323. One of the multiple control signals Vpp is supplied to one of the multiple element parts 51. The switching matrix 323 may output multiple control currents Ipp. One of the multiple control currents Ipp is supplied to one of the multiple element parts 51.

For example, at least a portion of the control circuits 310 and 311 is included in, for example, the controller 70.

Embodiments may include the following configurations (e.g., technological proposals).

Configuration 1

A MEMS element, comprising:
a first member; and
an element part,
the element part including
a first fixed electrode fixed to the first member,
a first movable electrode facing the first fixed electrode, a first conductive member electrically connected to the first movable electrode, and a second conductive member electrically connected to the first movable electrode, the first movable electrode being supported by the first and second conductive members to be separated from the first fixed electrode, the first conductive member having a meandering structure, the second conductive member including a first conductive region and a second conductive region, the second conductive region being between the first movable electrode and the first conductive region, a second width of the second conductive region along a second direction being less than a first width of the first conductive region along the second direction, the second direction crossing a first direction from the first movable electrode toward the first conductive region.

Configuration 2

The MEMS element according to Configuration 1, wherein the second width is not less than 0.1 times the first width.

Configuration 3

The MEMS element according to Configuration 1 or 2, wherein a length of the second conductive region along the first direction is less than a length of the first conductive region along the first direction.

Configuration 4

The MEMS element according to any one of Configurations 1 to 3, wherein the second conductive region overlaps an end portion of the first fixed electrode in a direction from the first fixed electrode toward the first movable electrode.

Configuration 5

The MEMS element according to any one of Configurations 1 to 3, wherein the first conductive member includes a first notch portion and a first non-notch portion, a direction from the first notch portion toward the first non-notch portion is along a first current path including the first conductive member and the first movable electrode, and a length of the first notch portion along a first cross direction perpendicular to the first current path is less than a length of the first non-notch portion along the first cross direction.

Configuration 6

The MEMS element according to Configuration 5, wherein the first notch portion overlaps an end portion of the first fixed electrode in a direction from the first fixed electrode toward the first movable electrode.

Configuration 7

The MEMS element according to any one of Configurations 1 to 6, wherein the element part further includes a second fixed electrode fixed to the first member, the first movable electrode includes a first electrode region and a second electrode region, a distance between the first electrode region and the first conductive member is less than a distance between the second electrode region and the first conductive member, the first electrode region faces the first fixed electrode, the second electrode region faces the second fixed electrode, and the first movable electrode is supported by the first and second conductive members to be separated from the second fixed electrode.

Configuration 8

The MEMS element according to Configuration 7, wherein the first movable electrode further includes a third electrode region between the first electrode region and the second electrode region, the element part includes:

a first supporter fixed to the first member;

a second supporter fixed to the first member; and a third supporter fixed to the first member, at least a portion of the first conductive member is supported by the first supporter to be separated from the first member, at least a portion of the second conductive member is supported by the second supporter to be separated from the first member, and at least a portion of the third electrode region is supported by the third supporter to be separated from the first member.

Configuration 9

The MEMS element according to any one of Configurations 1 to 6, wherein the first movable electrode includes a first electrode region, a second electrode region, and a third electrode region, the first electrode region is between the first conductive member and the second conductive member, the second electrode region is between the first electrode region and the second conductive member, the third electrode region is between the first electrode region and the second electrode region, the element part includes:

a first supporter fixed to the first member;

a second supporter fixed to the first member; and a third supporter fixed to the first member, at least a portion of the first conductive member is supported by the first supporter to be separated from the first member, at least a portion of the second conductive member is supported by the second supporter to be separated from the first member, and at least a portion of the third electrode region is supported by the third supporter to be separated from the first member.

Configuration 10

The MEMS element according to any one of Configurations 1 to 9, wherein the first movable electrode is supported by the first and second conductive members to be separated from the first fixed electrode in a first state before a first electrical signal is applied between the second conductive member and the first fixed electrode, and the first conductive member and the second conductive member are in a broken state in a second state after the first electrical signal is applied between the second conductive member and the first fixed electrode.

Configuration 11

A MEMS element, comprising:

a first member; and an element part, the element part including:

a first fixed electrode fixed to the first member;

a first movable electrode facing the first fixed electrode;

a first conductive member electrically connected to the first movable electrode; and a second conductive member electrically connected to the first movable electrode, the first movable electrode being supported by the first and second conductive members to be separated from the first fixed electrode, the first movable electrode including:

a first connection part connected with the first conductive member; and a second connection part connected with the second conductive member, a width of the first movable electrode along a second direction increasing in an orientation from the first connection part toward the second connection part in at least a portion of the first movable electrode, the second direction crossing a first direction from the first connection part toward the second connection part.

Configuration 12

The MEMS element according to Configuration 11, wherein the at least a portion of the first movable electrode includes a side portion oblique to the first direction.

Configuration 13

The MEMS element according to Configuration 11, wherein the element part further includes a second fixed electrode fixed to the first member, the first movable electrode includes a first electrode region and a second electrode region, a distance between the first electrode region and the first conductive member is less than a distance between the second electrode region and the first conductive member, the first electrode region faces the first fixed electrode, the second electrode region faces the second fixed electrode, the first movable electrode is supported by the first and second conductive members to be separated from the second fixed electrode, at least a portion of the first electrode region includes a side portion oblique to the first direction, and a width of the first electrode region along the second direction increases in the orientation from the first connection part toward the second connection part at the at least a portion of the first electrode region.

Configuration 14

The MEMS element according to Configuration 13, wherein the first movable electrode further includes a third electrode region between the first electrode region and the second electrode region, the element part includes:

a first supporter fixed to the first member;

a second supporter fixed to the first member; and a third supporter fixed to the first member, at least a portion of the first conductive member is supported by the first supporter to be separated from the first member, at least a portion of the second conductive member is supported by the second supporter to be separated from the first member, at least a portion of the third electrode region is supported by the third supporter to be separated from the first member.

Configuration 15

The MEMS element according to Configuration 11, wherein the first movable electrode includes a first electrode region, a second electrode region, and a third electrode region, the first electrode region is between the first conductive member and the second conductive member, the second electrode region is between the first electrode region and the second conductive member, the third electrode region is between the first electrode region and the second electrode region, the element part includes:

a first supporter fixed to the first member;

a second supporter fixed to the first member; and a third supporter fixed to the first member, at least a portion of the first conductive member is supported by the first supporter to be separated from the first member, at least a portion of the second conductive member is supported by the second supporter to be separated from the first member, at least a portion of the third electrode region is supported by the third supporter to be separated from the first member, at least a portion of the first electrode region includes a side portion oblique to the first direction, and a width of the first electrode region along the second direction increases in the orientation from the first connection part toward the second connection part at the at least a portion of the first electrode region.

Configuration 16

The MEMS element according to any one of Configurations 11 to 15, wherein the first conductive member has a meandering structure, the second conductive member includes a first conductive region and a second conductive region, the second conductive region is between the first movable electrode and the first conductive region, and a second width of the second conductive region along the second direction is less than a first width of the first conductive region along the second direction.

Configuration 17

The MEMS element according to Configuration 16, wherein the second conductive region overlaps an end portion of the first fixed electrode in a direction from the first fixed electrode toward the first movable electrode.

Configuration 18

The MEMS element according to Configuration 16 or 17, wherein the first conductive member includes a first notch portion and a first non-notch portion, a direction from the first notch portion toward the first non-notch portion is along a first current path including the first conductive member and the first movable electrode, and a length of the first notch portion along a first cross direction is less than a length of the first non-notch portion along the first cross direction perpendicular to the first current path.

Configuration 19

The MEMS element according to Configuration 18, wherein the first notch portion overlaps an end portion of the first fixed electrode in a direction from the first fixed electrode toward the first movable electrode.

Configuration 20

An electrical circuit, comprising:

the MEMS element according to any one of Configurations 1 to 19; and an electrical element electrically connected to the MEMS element.

According to embodiments, a MEMS element and an electrical circuit can be provided in which a stable operation is possible.

Hereinabove, exemplary embodiments of the invention are described with reference to specific examples. However, the embodiments of the invention are not limited to these specific examples. For example, one skilled in the art may similarly practice the invention by appropriately selecting specific configurations of components included in MEMS elements and electrical circuits such as first members, element parts, fixed electrodes, movable electrodes, first conductive members, second conductive members, etc., from known art. Such practice is included in the scope of the invention to the extent that similar effects thereto are obtained.

Further, any two or more components of the specific examples may be combined within the extent of technical feasibility and are included in the scope of the invention to the extent that the purport of the invention is included.

Moreover, all MEMS elements, and electrical circuits practicable by an appropriate design modification by one skilled in the art based on the MEMS elements, and the electrical circuits described above as embodiments of the invention also are within the scope of the invention to the extent that the purport of the invention is included.

Various other variations and modifications can be conceived by those skilled in the art within the spirit of the invention, and it is understood that such variations and modifications are also encompassed within the scope of the invention.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions, In the specification and drawings, components similar to those described previously or illustrated in an antecedent drawing are marked with like reference numerals, and a detailed description is omitted as appropriate.

What is claimed is:

1. A MEMS element, comprising:

a first member; and an element part, the element part including a first fixed electrode fixed to the first member, a first movable electrode facing the first fixed electrode, a first conductive member electrically connected to the first movable electrode, and a second conductive member electrically connected to the first movable electrode, the first movable electrode being supported by the first and second conductive members to be separated from the first fixed electrode, the first conductive member having a meandering structure, the second conductive member including a first conductive region and a second conductive region, the second conductive region being between the first movable electrode and the first conductive region, a second width of the second conductive region along a second direction being less than a first width of the first conductive region along the second direction, the second direction crossing a first direction from the first movable electrode toward the first conductive region, wherein:

the first movable electrode is supported by the first and second conductive members to be separated from the first fixed electrode in a first state before a first electrical signal is applied between the second conductive member and the first fixed electrode, and the first conductive member and the second conductive member are in a broken state in a second state after the first electrical signal is applied between the second conductive member and the first fixed electrode.

2. A MEMS element, comprising:

a first member; and an element part, the element part including:

a first fixed electrode fixed to the first member;

a first movable electrode facing the first fixed electrode;

a first conductive member electrically connected to the first movable electrode; and a second conductive member electrically connected to the first movable electrode, the first movable electrode being supported by the first and second conductive members to be separated from the first fixed electrode, the first movable electrode including:

a first connection part connected with the first conductive member; and a second connection part connected with the second conductive member, a width of the first movable electrode along a second direction increasing in an orientation from the first connection part toward the second connection part in at least a portion of the first movable electrode, the second direction crossing a first direction from the first connection part toward the second connection part, wherein:

the first conductive member has a meandering structure, the second conductive member includes a first conductive region and a second conductive region, the second conductive region is between the first movable electrode and the first conductive region, a second width of the second conductive region along the second direction is less than a first width of the first conductive region along the second direction, the first conductive member includes a first notch portion and a first non-notch portion, a direction from the first notch portion toward the first non-notch portion is along a first current path including the first conductive member and the first movable electrode, and a length of the first notch portion along a first cross direction perpendicular to the first current path is less than a length of the first non-notch portion along the first cross direction.

3. The MEMS element according to claim 2, wherein the first notch portion overlaps an end portion of the first fixed electrode in a direction from the first fixed electrode toward the first movable electrode.

4. A MEMS element, comprising:

a first member; and an element part, the element part including:

a first fixed electrode fixed to the first member;

a first movable electrode facing the first fixed electrode;

a first conductive member electrically connected to the first movable electrode; and a second conductive member electrically connected to the first movable electrode, the first movable electrode being supported by the first and second conductive members to be separated from the first fixed electrode, the first movable electrode including:

a first connection part connected with the first conductive member; and a second connection part connected with the second conductive member, a width of the first movable electrode along a second direction increasing in an orientation from the first connection part toward the second connection part in at least a portion of the first movable electrode, the second direction crossing a first direction from the first connection part toward the second connection part, wherein:

the first conductive member has a meandering structure, the second conductive member includes a first conductive region and a second conductive region, the second conductive region is between the first movable electrode and the first conductive region, a second width of the second conductive region along the second direction is less than a first width of the first conductive region along the second direction, the second conductive region overlaps an end portion of the first fixed electrode in a direction from the first fixed electrode toward the first movable electrode.

5. The MEMS element according to claim 4, wherein the at least a portion of the first movable electrode includes a side portion oblique to the first direction.

6. The MEMS element according to claim 4, wherein the first movable electrode includes a first electrode region, a second electrode region, and a third electrode region, the first electrode region is between the first conductive member and the second conductive member, the second electrode region is between the first electrode region and the second conductive member, the third electrode region is between the first electrode region and the second electrode region, the element part includes:

a first supporter fixed to the first member;

a second supporter fixed to the first member; and a third supporter fixed to the first member, at least a portion of the first conductive member is supported by the first supporter to be separated from the first member, at least a portion of the second conductive member is supported by the second supporter to be separated from the first member, at least a portion of the third electrode region is supported by the third supporter to be separated from the first member, at least a portion of the first electrode region includes a side portion oblique to the first direction, and a width of the first electrode region along the second direction increases in the orientation from the first connection part toward the second connection part at the at least a portion of the first electrode region.

7. The MEMS element according to claim 4, wherein the element part further includes a second fixed electrode fixed to the first member, the first movable electrode includes a first electrode region and a second electrode region, a distance between the first electrode region and the first conductive member is less than a distance between the second electrode region and the first conductive member, the first electrode region faces the first fixed electrode, the second electrode region faces the second fixed electrode, the first movable electrode is supported by the first and second conductive members to be separated from the second fixed electrode, at least a portion of the first electrode region includes a side portion oblique to the first direction, and a width of the first electrode region along the second direction increases in the orientation from the first connection part toward the second connection part at the at least a portion of the first electrode region.

8. The MEMS element according to claim 7, wherein the first movable electrode further includes a third electrode region between the first electrode region and the second electrode region, the element part includes:

a first supporter fixed to the first member;

a second supporter fixed to the first member; and a third supporter fixed to the first member, at least a portion of the first conductive member is supported by the first supporter to be separated from the first member, at least a portion of the second conductive member is supported by the second supporter to be separated from the first member, and at least a portion of the third electrode region is supported by the third supporter to be separated from the first member.

9. A MEMS element, comprising:
a first member; and
an element part,
the element part including
a first fixed electrode fixed to the first member,
a first movable electrode facing the first fixed electrode,
a first conductive member electrically connected to the first movable electrode, and
a second conductive member electrically connected to the first movable electrode,
the first movable electrode being supported by the first and second conductive members to be separated from the first fixed electrode,
the first conductive member having a meandering structure,
the second conductive member including a first conductive region and a second conductive region,
the second conductive region being between the first movable electrode and the first conductive region,
a second width of the second conductive region along a second direction being less than a first width of the first conductive region along the second direction,
the second direction crossing a first direction from the first movable electrode toward the first conductive region,
wherein:
the first conductive member includes a first notch portion and a first non-notch portion,
a direction from the first notch portion toward the first non-notch portion is along a first current path including the first conductive member and the first movable electrode, and
a length of the first notch portion along a first cross direction perpendicular to the first current path is less than a length of the first non-notch portion along the first cross direction.

10. The MEMS element according to claim 9, wherein the second width is not less than 0.1 times the first width.

11. The MEMS element according to claim 9, wherein
a length of the second conductive region along the first direction is less than a length of the first conductive region along the first direction.

12. The MEMS element according to claim 9, wherein
the second conductive region overlaps an end portion of the first fixed electrode in a direction from the first fixed electrode toward the first movable electrode.

13. The MEMS element according to claim 9, wherein
the first notch portion overlaps an end portion of the first fixed electrode in a direction from the first fixed electrode toward the first movable electrode.

14. The MEMS element according to claim 9, wherein
the first movable electrode includes a first electrode region, a second electrode region, and a third electrode region,
the first electrode region is between the first conductive member and the second conductive member,
the second electrode region is between the first electrode region and the second conductive member,
the third electrode region is between the first electrode region and the second electrode region,
the element part includes:
a first supporter fixed to the first member;
a second supporter fixed to the first member; and
a third supporter fixed to the first member,
at least a portion of the first conductive member is supported by the first supporter to be separated from the first member,
at least a portion of the second conductive member is supported by the second supporter to be separated from the first member, and
at least a portion of the third electrode region is supported by the third supporter to be separated from the first member.

15. An electrical circuit, comprising:
the MEMS element according to claim 9; and
an electrical element electrically connected to the MEMS element.

16. The MEMS element according to claim 9, wherein
the element part further includes a second fixed electrode fixed to the first member,
the first movable electrode includes a first electrode region and a second electrode region,
a distance between the first electrode region and the first conductive member is less than a distance between the second electrode region and the first conductive member,
the first electrode region faces the first fixed electrode,
the second electrode region faces the second fixed electrode, and
the first movable electrode is supported by the first and second conductive members to be separated from the second fixed electrode.

17. The MEMS element according to claim 16, wherein
the first movable electrode further includes a third electrode region between the first electrode region and the second electrode region,
the element part includes:
a first supporter fixed to the first member;
a second supporter fixed to the first member; and
a third supporter fixed to the first member,
at least a portion of the first conductive member is supported by the first supporter to be separated from the first member,
at least a portion of the second conductive member is supported by the second supporter to be separated from the first member, and
at least a portion of the third electrode region is supported by the third supporter to be separated from the first member.

* * * * *